US007552924B2

(12) United States Patent
Sano et al.

(10) Patent No.: US 7,552,924 B2
(45) Date of Patent: Jun. 30, 2009

(54) SHEET FEEDING APPARATUS, IMAGE READING APPARATUS EQUIPPED WITH THE SAME, AND METHOD OF DETECTING DOUBLE FEED

(75) Inventors: Kazuhide Sano, Yamanashi-ken (JP); Syunichi Hirose, Minami-Alps (JP)

(73) Assignee: Nisca Corporation, Yamanashi-Ken (JP)

( * ) Notice: Subject to any disclaimer, the term of this patent is extended or adjusted under 35 U.S.C. 154(b) by 857 days.

(21) Appl. No.: 11/002,268

(22) Filed: Dec. 3, 2004

(65) Prior Publication Data

US 2005/0127597 A1 Jun. 16, 2005

(30) Foreign Application Priority Data

Dec. 4, 2003 (JP) ..... 2003-405438
Dec. 4, 2003 (JP) ..... 2003-405440

(51) Int. Cl.
*B65H 7/12* (2006.01)

(52) U.S. Cl. ..... 271/263; 271/242; 271/265.04

(58) Field of Classification Search ..... 271/3.15, 271/3.17, 10.02, 10.03, 110, 258.01–258.04, 271/262, 263, 265.01, 265.04, 152, 154–155
See application file for complete search history.

(56) References Cited

U.S. PATENT DOCUMENTS 2,998,823 A * 9/1961 McCown et al. ..... 134/46
4,066,969 A * 1/1978 Pearce et al. ..... 367/125
4,237,378 A * 12/1980 Jones ..... 250/223 R
4,944,505 A * 7/1990 Sherman, III ..... 271/265.03
5,351,112 A * 9/1994 Naito et al. ..... 399/370
5,389,848 A * 2/1995 Trzaskos ..... 310/322
5,623,307 A * 4/1997 Kotidis et al. ..... 356/493
5,889,209 A * 3/1999 Piedrahita et al. ..... 73/570
6,027,108 A * 2/2000 Johdai et al. ..... 271/3.02
6,040,923 A * 3/2000 Takashimizu et al. ..... 358/498
6,053,495 A * 4/2000 Hara et al. ..... 271/263
6,212,130 B1 * 4/2001 Brazeal et al. ..... 367/93

(Continued)

FOREIGN PATENT DOCUMENTS

JP 6-49567 12/1994

OTHER PUBLICATIONS

Patent Abstracts of Japan; Publication No. 10-257595; Date of publication Sep. 25, 1998; Applicant: Murata Mfg Co Ltd; Title: Ultrasonic Sensor.

*Primary Examiner*—Patrick H Mackey
*Assistant Examiner*—Jeremy Severson
(74) *Attorney, Agent, or Firm*—Manabu Kanesaka

(57) ABSTRACT

A sheet feeding apparatus includes two transport devices arranged in a sheet guide that guides a sheet from a stacker to a processing position for reading an image or printing. A double feed detection device is arranged between the transport devices for detecting a double feed of the sheets over a predetermined length region (measurement length). A sheet length recognition device is provided for recognizing at least two portions of a length of the sheet stacked on the stacker in a transport direction, and a judgment device is provided for judging the double feed of the sheets based upon detection data from the double feed detection device. The judgment device judges the double feed of the sheets according to detection data of one measurement region selected from a plurality of measurement regions based on information obtained from the sheet length recognition device.

8 Claims, 15 Drawing Sheets

U.S. PATENT DOCUMENTS 6,224,051 B1 * 5/2001 Nakayama et al. ..... 271/115
6,281,679 B1 * 8/2001 King et al. ..... 324/229
6,314,054 B1 * 11/2001 Priebsch ..... 367/93
6,324,900 B1 * 12/2001 Bruno et al. ..... 73/61.48
6,493,289 B2 * 12/2002 Kitaori et al. ..... 367/189
6,511,064 B1 * 1/2003 Phinney et al. ..... 271/262
6,520,498 B2 * 2/2003 Phinney ..... 271/263
6,565,079 B1 * 5/2003 Kakegawa et al. ..... 271/125
6,592,825 B2 * 7/2003 Pelc et al. ..... 422/100
6,619,655 B2 * 9/2003 Muller et al. ..... 271/152
6,691,578 B1 * 2/2004 Puskas ..... 73/648
6,698,753 B2 * 3/2004 Chujo et al. ..... 271/262
6,739,591 B2 * 5/2004 Chujo et al. ..... 271/262
6,804,473 B2 * 10/2004 Nakamura et al. ..... 399/16
6,874,778 B2 * 4/2005 Nakano et al. ..... 271/111
6,898,151 B1 * 5/2005 Lyon ..... 367/99
6,904,405 B2 * 6/2005 Suominen ..... 704/235
6,917,326 B1 * 7/2005 Tregenza et al. ..... 342/124
6,923,066 B2 * 8/2005 Ogawa ..... 73/626
2001/0014477 A1 * 8/2001 Pelc et al. ..... 436/49
2001/0042956 A1 * 11/2001 Minoru et al. ..... 271/265.04
2002/0007118 A1 * 1/2002 Adachi et al. ..... 600/443
2002/0020957 A1 * 2/2002 Araki et al. ..... 271/10.11
2002/0060393 A1 * 5/2002 Muller et al. ..... 271/110
2002/0066994 A1 * 6/2002 Nakano et al. ..... 271/121
2002/0079644 A1 * 6/2002 Phinney ..... 271/258.01
2003/0006550 A1 * 1/2003 Chujo et al. ..... 271/262
2003/0060707 A1 * 3/2003 Ogawa ..... 600/437
2003/0094748 A1 * 5/2003 Chujo et al. ..... 271/262
2003/0208133 A1 * 11/2003 Mault ..... 600/532
2004/0100018 A1 * 5/2004 Phinney et al. ..... 271/262
2005/0034520 A1 * 2/2005 Eisen et al. ..... 73/627

* cited by examiner

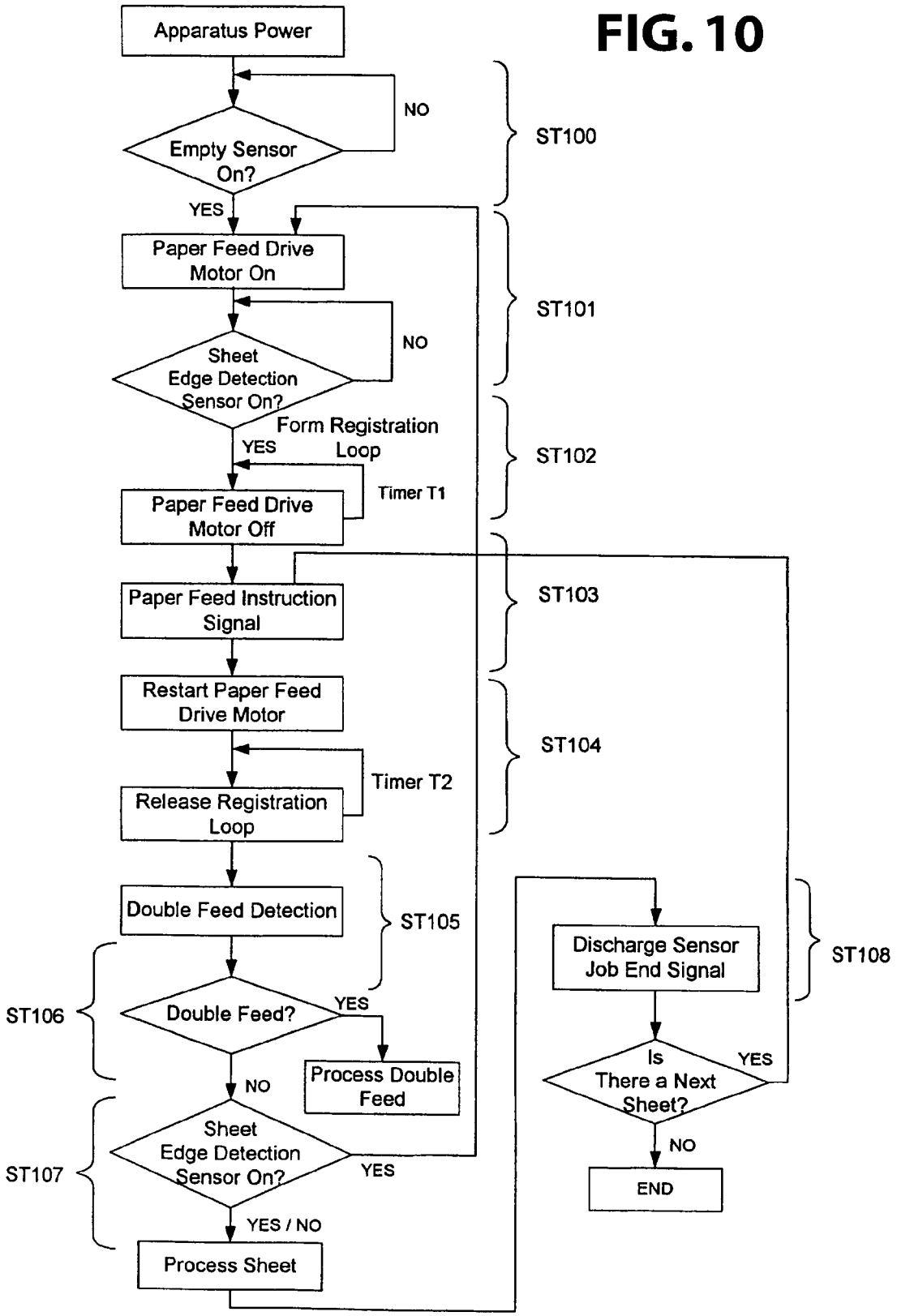
FIG. 10
Apparatus Power
Empty Sensor On?
NO
YES
ST100
Paper Feed Drive Motor On
Sheet Edge Detection Sensor On?
NO
ST101
Form Registration Loop
YES
Timer T1
Paper Feed Drive Motor Off
ST102
Paper Feed Instruction Signal
ST103
Restart Paper Feed Drive Motor
Release Registration Loop
Timer T2
ST104
Double Feed Detection
ST105
ST106
Double Feed?
YES
Process Double Feed
NO
ST107
Sheet Edge Detection Sensor On?
YES
YES / NO
Process Sheet
Discharge Sensor Job End Signal
ST108
Is There a Next Sheet?
YES
NO
END

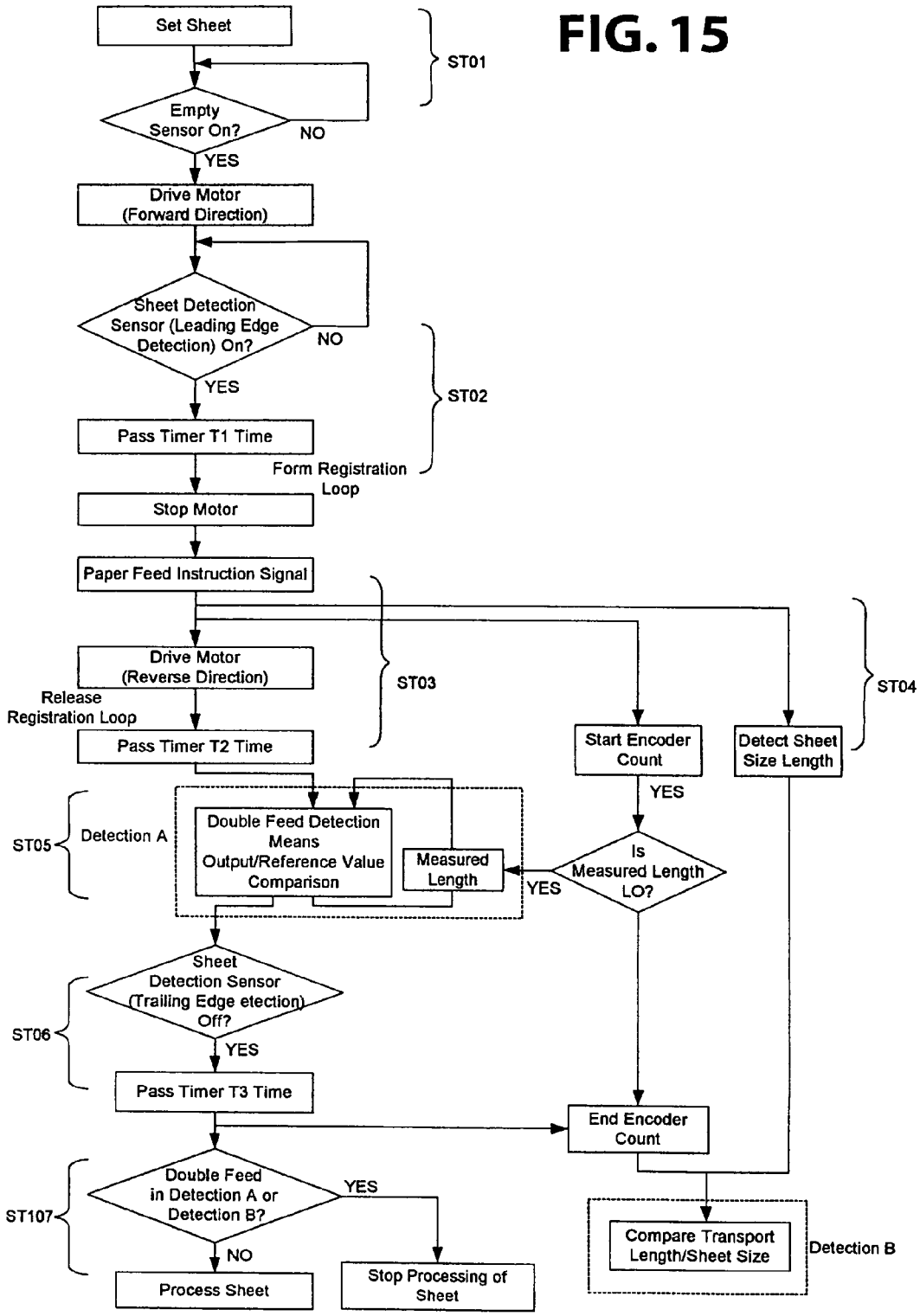
FIG. 15
Set Sheet
ST01
Empty Sensor On?
NO
YES
Drive Motor (Forward Direction)
Sheet Detection Sensor (Leading Edge Detection) On?
NO
YES
ST02
Pass Timer T1 Time
Form Registration Loop
Stop Motor
Paper Feed Instruction Signal
Drive Motor (Reverse Direction)
ST03
ST04
Release Registration Loop
Pass Timer T2 Time
Start Encoder Count
Detect Sheet Size Length
YES
ST05
Detection A
Double Feed Detection Means Output/Reference Value Comparison
Measured Length
YES
Is Measured Length LO?
Sheet Detection Sensor (Trailing Edge etection) Off?
ST06
YES
Pass Timer T3 Time
End Encoder Count
Double Feed in Detection A or Detection B?
YES
ST107
NO
Process Sheet
Stop Processing of Sheet
Compare Transport Length/Sheet Size
Detection B

SHEET FEEDING APPARATUS, IMAGE READING APPARATUS EQUIPPED WITH THE SAME, AND METHOD OF DETECTING DOUBLE FEED

BACKGROUND OF THE INVENTION AND RELATED ART STATEMENT

The present invention relates to a sheet feeding apparatus for sequentially separating sheets on a stacker into a single sheet and feeding the sheet one by one to a processing station for reading images or printing. The present invention also relates to a method of detecting a double feed of a plurality of sheets in a sheet feeding process.

A conventional sheet feeding apparatus sequentially feeds sheets stacked on a stacker to a processing station such as a printer, copier, or scanner. It is necessary to accurately separate the sheets into a single sheet and to detect a double feed of the sheets before the sheet reaches the processing station, so that it is possible to stop processing or discard processing data such as reading information. In the process of separating the sheets stacked on a stacker into a single sheet and feeding the sheet one by one to the processing station, if the double feed of the sheets occurs, an incorrect process is applied to the sheets at the processing station.

A conventional method of detecting the double feed of the sheets includes an ultrasonic sensor, a photo-sensor, or the like for detecting attenuation in an ultrasonic wave or an intensity of light passing through the sheet, thereby determining whether there is a single sheet.

Japanese Patent Publication (Kokai) No. 10-257595 discloses an ultrasonic sensor for detecting a sheet. The ultrasonic sensor includes a piezoelectric oscillation plate such as piezoelectric ceramic at a wave transmission side. A pulse voltage with a predetermined frequency is applied to the piezoelectric oscillation plate to generate oscillation, thereby transmitting ultrasonic waves. A similar oscillation plate is provided at a wave reception side for receiving ultrasonic waves and converting to an electrical signal. Electric energy applied to the piezoelectric oscillation plate (wave transmission element) at the wave transmission side is compared with electric energy generated at the piezoelectric oscillation plate (wave reception element) at the wave reception side, thereby determining a single sheet or several sheets.

When the double feed is detected with such an ultrasonic sensor, it is necessary to accurately measure ultrasonic energy (electric energy output from the wave reception element) attenuated through the sheet between the wave transmission element and the wave reception element. U.S. Pat. No. 6,212,130 discloses a conventional structure in which a wave transmission element and a wave reception element are arranged opposite to each other with a predetermined angle relative to a surface of a sheet. With this structure, it is possible to prevent ultrasonic waves transmitted from the wave transmission element from reflecting at the sheet surface and interfering.

Japanese Utility Model (Kokoku) No. 06-49567 proposes a structure in which a wave transmission element and a wave reception element are arranged opposite to each other between a downstream roller and an upstream roller arranged with a predetermined distance in between, thereby making it possible to detect the double feed while a sheet is in a stable condition. More specifically, with such a structure, the double feed is detected while the downstream and upstream rollers nip the sheet in a straight position during transportation. Accordingly, it is possible to accurately detect the double feed since a leading end or a trailing end of the sheet is not curved or does not oscillate vertically. When ultrasonic waves or an intensity of light transmitting the sheet moving at a predetermined speed is measured to determine a difference between a single sheet and several sheets, it is necessary to reduce a variation in a posture of the sheet. It is also necessary to measure and smooth data over a predetermined length (region) of the sheet.

In order to detect the double feed of the sheets using the double feed detection device such as an ultrasonic wave sensor described above, it is necessary to hold the sheet between a pair of rollers at front and rear sides of the sheet, so that the sheet travels between the transmission element and the reception element in a constant posture, such as the case proposed in Japanese Utility Model (Kokoku) No. 06-49567. It is also necessary to smooth measured data continuously detected over a specific region of the sheet to determine the double feed.

In the conventional structure disclosed in Japanese Utility Model (Kokoku) No. 06-49567, the rollers are arranged at front and rear sides of the sheet in the transport direction with a distance in between shorter than a length of the minimum size sheet, and the double feed is detected using detection data measured over a measurement range (region) smaller than the distance. When sheets in a wide size range from small to large are transported, if the measurement range is set according to a length of the minimum size sheet in the transport direction, it is possible to detect a part of a leading edge and send the sheet to a sheet processing unit as a single sheet when two large size sheets are overlapped and shifted in the transport direction. When the measurement range is set according to a length of a middle or large size sheet in the transport direction, it is also possible to cause an erroneous detection as a trailing edge of a small sized sheet comes off a transport device and flaps when a detection sensor detects the double feed.

In view of the problems described above, an object of the present invention is to provide a method of detecting double feed in which it is possible to accurately determine a single sheet or several sheets when sheets with different lengths in a transport direction are transported. In particular, it is possible to accurately detect two sheets overlapped each other and shifted in the transport direction.

Another object of the present invention is to provide a sheet feeding apparatus using the method of detecting the double feed.

A further object of the present invention is to provide a sheet feeding apparatus and a method of detecting the double feed, in which it is possible to accurately detect the double feed of sheets fed from a stacker with a simple structure when sheets with sizes different from standard are transported or sheets are shifted in the transport direction.

Further objects and advantages of the invention will be apparent from the following description of the invention.

SUMMARY OF THE INVENTION

In order to attain the objects described above, according to the present invention, at least two transport devices, i.e., a first transport device and second transport device, are arranged in a sheet guide that guides a sheet from a stacker to a processing position for reading an image or printing. A double feed detection device is arranged between the first transport device and the second transport device for detecting a double feed of the sheets over a predetermined length region (measurement length). A sheet length recognition device is provided for recognizing at least two portions of a length of the sheet stacked on the stacker in a transport direction, and a judgment device is provided for judging the double feed of the sheets based upon detection data from the double feed detection device. The judgment device judges the double feed of the sheets according to detection data of one measurement region selected from a plurality of measurement regions based on information obtained from the sheet length recognition device.

The first transport device may comprise a separating roller for separating the sheets stacked on the stacker into a single sheet and feeding the sheet. The second transport device may comprise a register roller for temporarily holding the sheet fed from the separating roller. The first and second transport devices are arranged at positions with a distance in between smaller than a length of a minimum size sheet in the transport direction. Accordingly, the double feed detection device detects the double feed in a state that leading and trailing edges of the sheet are nipped by the rollers, i.e., the first transport device nips the leading edge and the second transport device nips the trailing edge.

The double feed detection device may include an ultrasonic wave sensor or a photo-sensor for detecting a single sheet or several sheets according to an amount of ultrasonic waves or light passing through the sheet. It is preferred that an oscillating element and a receiving element are arranged at opposite positions with a predetermined angle relative to the sheet moving between the first and second transport devices. The receiving element may be arranged at an upper position and the oscillating element may be arranged at a lower position relative to the sheet in the direction of gravity.

The sheet length recognition device may have a structure for recognizing the length of the sheet when an operator inputs a sheet size through an operation panel. The sheet length recognition device may have a sensor for detecting an edge of the sheet on the stacker to recognize the length of the sheet in the transport direction.

The sheet length recognition device may recognize at least two portions (long and short) of the length of the sheet in the transport direction, or may measure an actual length of the sheet to recognize the length of the sheet in the transport direction.

The judgment device is configured to detect the double feed of the sheets using detection data over a measurement length corresponding to the sheet length recognized as more than two portions by the sheet length recognition device. Preferably, the sheet length recognition device measures the sheet length in the transport direction to determine an actual length or a standard size. A predetermined length is subtracted from the sheet length in the transport direction to form a non-detection region where the first and second transport devices nip the leading and trailing edges of the sheet.

According to the present invention, a method of detecting a double feed of sheets sequentially transported from a stacker to a processing platen includes a first step of recognizing at least two portions of a length of the sheet in the transport direction; a second step of detecting the double feed of the sheets in a sheet transport process using a double feed detection sensor; a third step of setting a measurement length region based upon the length of the sheet recognized in the first step; and a fourth step of judging the double feed of the sheets based upon detection data from the double feed sensor over the measurement length region set in the third step.

When the double feed detection device detects the double feed of the sheets transported between the first and second transport devices, one of several measurement lengths is selected according to the length of the sheet in the transport direction. Accordingly, it is possible to detect the double feed even when the sheets are overlapped and shifted in the transport direction, as compared with a conventional method of detecting the double feed over one specific region of the sheet nipped by two transport devices. Therefore, it is possible to securely detect the double feed of the sheets with different sizes when the sheets are overlapped and shifted in the transport direction.

According to the present invention, a stacker is provided for stacking a sheet, and a sheet size recognition device is provided for recognizing a length of the sheet stacked on the stacker in the transport direction. At least two transport devices are disposed in a transport guide that guides the sheet from the stacker to a processing platen for reading an image or printing. A double feed detection device such as an ultrasonic wave sensor is arranged between the transport devices. A transport length detection device is provided for detecting a length of the sheet transported in the transport guide from a leading edge to a trailing edge thereof. A comparison device compares the length of the sheet in the transport direction detected by the transport length detection device with the length of the sheet in the transport direction recognized by the sheet size recognition device. A judgment device is provided for judging the double feed of the sheets based upon a comparison result (long or short) from the comparison device and a detection result (single sheet, or several sheets) from the double feed detection device.

The double feed detection device detects a predetermined region (length) at the leading edge or the central portion of the sheet transported from the stacker. Accordingly, it is possible to detect the double feed of the sheets supported by the first and the second sheet transport devices in a stable posture. The transport length detection device detects the length of the sheet even when the sheets are overlapped and shifted in the transport direction, and when the length exceeds a predetermined length, it is judged to be the double feed.

In the present invention, the double feed is detected with the double feed detection device such as an ultrasonic sensor for detecting the double feed of the sheets in the transport process from the stacker to the processing platen, and the comparison device for comparing the transport length of the sheet from the leading edge to the trailing edge thereof with the length of the sheet itself. Accordingly, it is possible to accurately detect the double feed with one of the double feed detection device and the comparison device even when the sheets are overlapped and shifted in the transport direction. That is, it is possible to accurately detect the double feed even when sheets with various sizes are overlapped and transported, thereby preventing an improper operation at the processing platen.

BRIEF DESCRIPTION OF THE DRAWINGS

FIG. 10 is a flow chart showing a control of the image forming apparatus shown in FIG. 6;

FIG. 15 is a flowchart showing a control of the sheet feeding apparatus shown in FIG. 12.

DETAILED DESCRIPTION OF PREFERRED EMBODIMENTS

Figure 1:
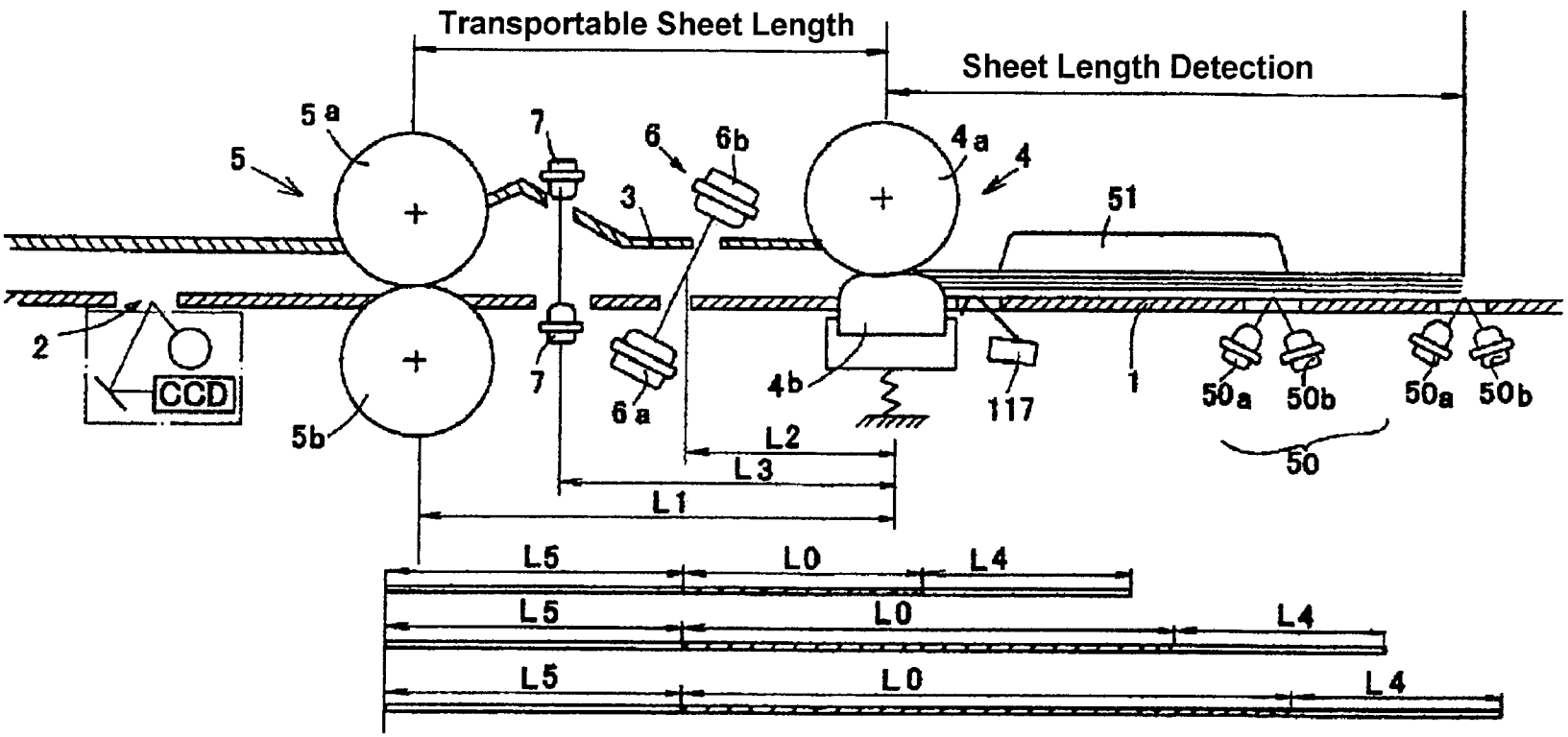
FIG. 1 is a schematic view of a sheet feeding apparatus according to an embodiment of the present invention.
Figure 2:
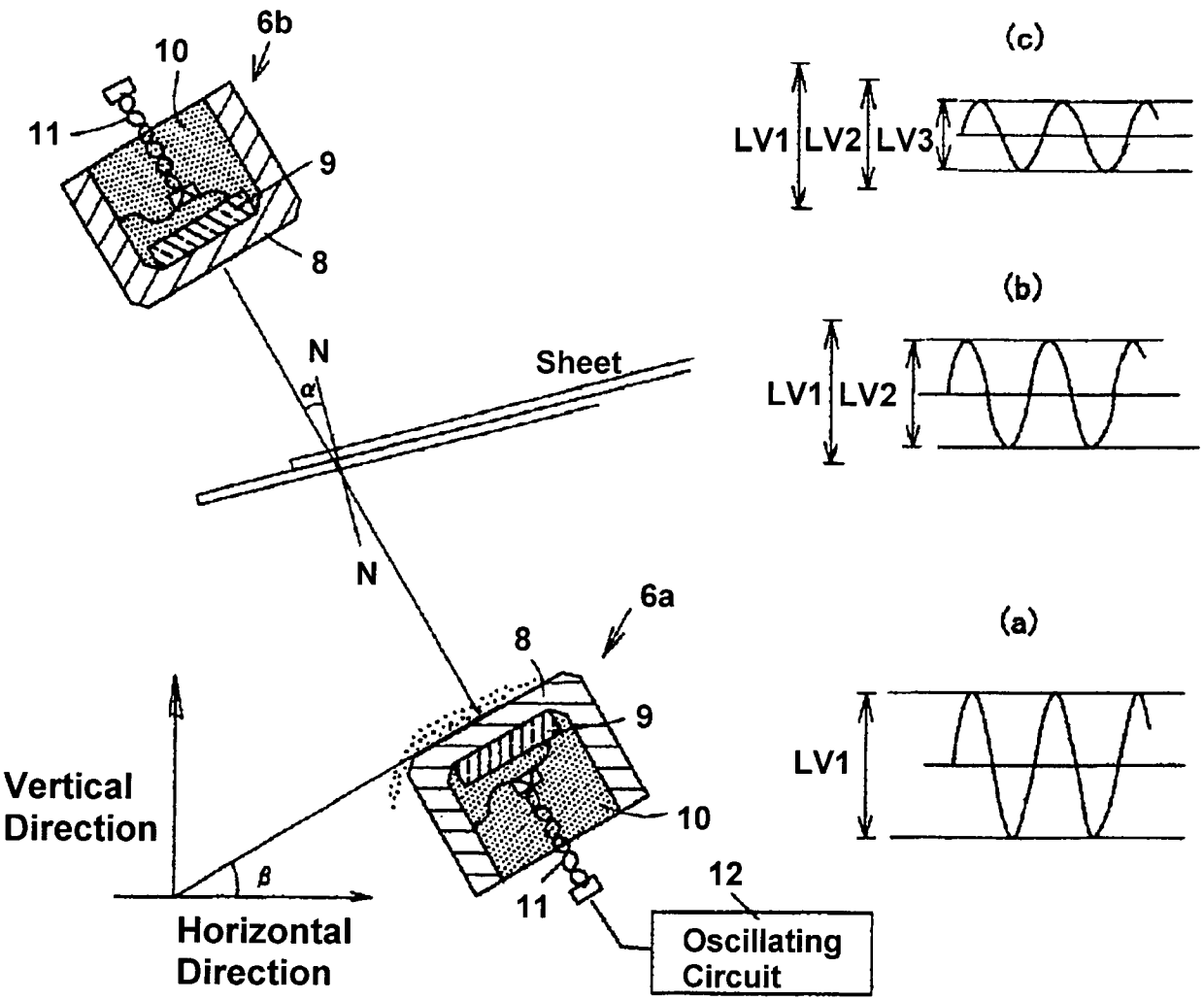
FIG. 2 is a view showing an ultrasonic wave sensor as an example of a double feed detection device of the sheet feeding apparatus shown in FIG. 1.
Figure 3:
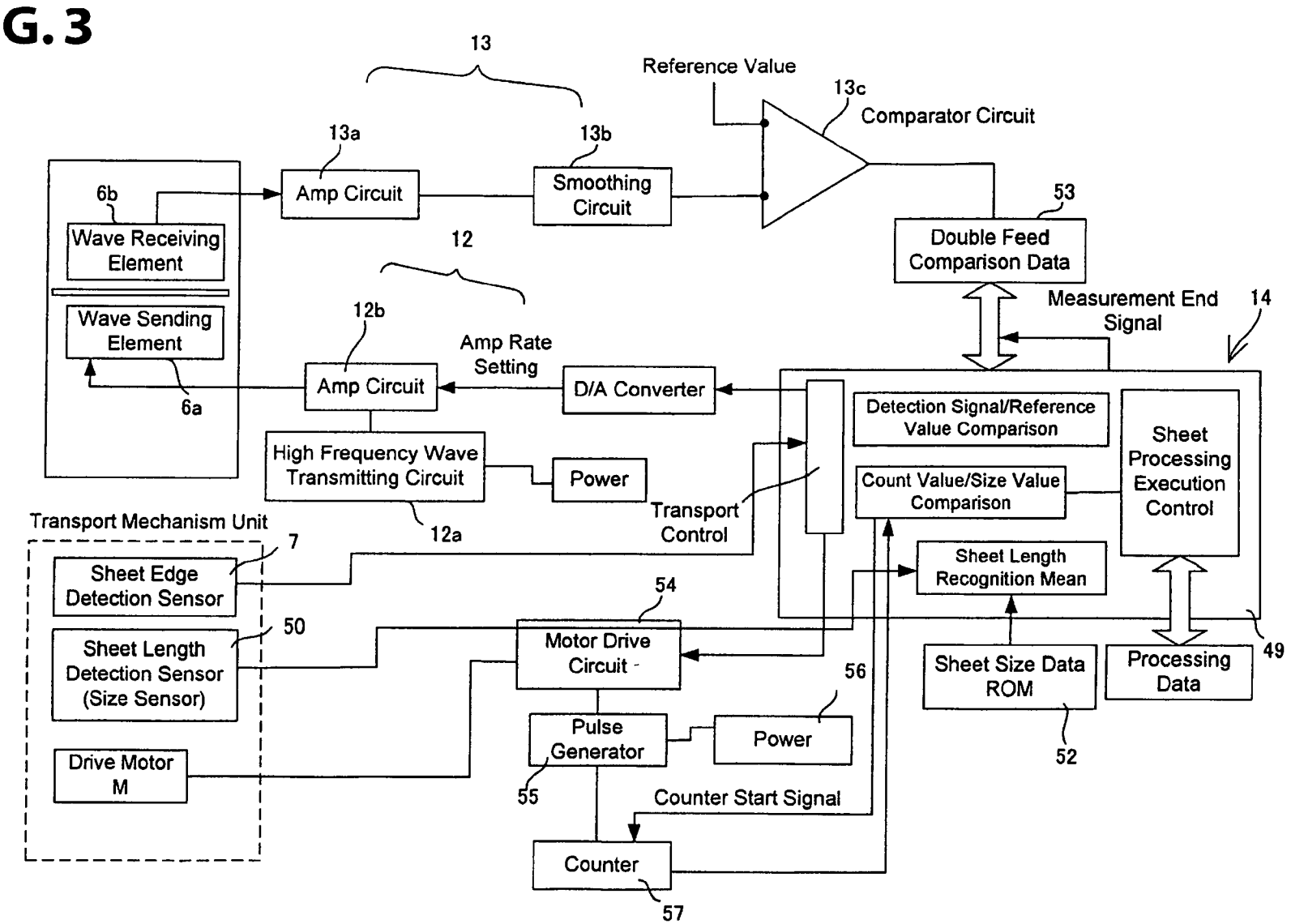
FIG. 3 is a block diagram of a control circuit of the sheet feeding apparatus shown in FIG. 1.

Hereunder, preferred embodiments of the present invention will be explained with reference to the accompanied drawings. FIG. 1 is a schematic view of a sheet feeding apparatus according to an embodiment of the present invention. FIG. 2 is a schematic view of a double feed detection device composed of an ultrasonic wave sensor. FIG. 3 is a circuit diagram of a control circuit. The invention applies to an apparatus and to a method for detecting double feed of two or more overlapped sheets before a processing position when the sheets stacked on a stacker in a sheet feeding unit of an image reading apparatus such as a copier, or printer are separated and transported one by one to the processing position such as an image reading platen, or printing platen.

As shown in FIG. 1, the sheet feeding apparatus is equipped with a stacker 1 for storing sheets; a sheet guide 3 for guiding the sheets from the stacker 1 to a processing platen 2; at least two transport devices, i.e., first and second transport devices 4 and 5, arranged on the sheet guide 3; and a double feed detection device 6 arranged between the first transport device 4 and the second transport device 5 for detecting double feed of the sheets.

The stacker 1 is composed of a tray for stacking the sheets. A sheet length recognition device 49 is disposed on the stacker 1 for detecting a length of the sheets in a transport direction. The sheet length recognition device 49 may include (1) an input device with which an operator inputs a sheet standard size from a control panel; (2) a sensor device arranged at several positions along the transport direction for detecting an edge of the sheet stacked on the stacker; or (3) a sliding guide sliding along an edge of the sheet stacked on the stacker, and a guide detection device for detecting a position of the sliding guide with a sensor.

The sheet feeding apparatus in FIG. 1 includes size sensors 50 for detecting a trailing edge of the sheet in the transport direction. Each of the size sensors 50 is formed of a photodiode 50*a* and a light receiving element 50*b*. The size sensors 50 are arranged along a bottom of the stacker 1 at a plurality of positions corresponding to an edge of a standard size sheet. A movable side guide 51 is disposed on the stacker 1 and extends in a width direction of the sheet. A position of the side guide 51 is detected by a sensor (not shown). Therefore, it is possible to determine a standard size from a length detected by the size sensors 50 and a width detected by the side guide 51.

The first transport device 4 comprises a separating roller 4*a* that separates the sheets stacked on the stacker into a single sheet and feeds the sheet one by one to the processing platen 2, and a friction pad 4*b* that presses against the roller 4*a*. A variety of separating devices are known in the art. Instead of the separating roller 4*a*, a belt may be employed. Instead of the friction pad 4*b*, a reverse-rotating roller or a belt may be employed.

The second transport device 5 comprises a pair of rollers that press against each other, or a belt for transporting the sheet from the first transport device 4. As shown in the drawing, the second transport device 5 temporarily holds the sheet from the first transport device 4, then transports the sheet toward the processing platen 2 with a paper feed timing signal.

The first and second transport devices may be connected to individual drive motors, or a drive motor capable of rotating in forward and reverse directions. With the forward rotation, the first transport device 4 rotates; and with the reverse rotation, the second transport device 5 rotates as described in further detail with reference to FIG. 9. The first and second transport devices 4 and 5 rotate in opposite directions, so that the first transport device 4 with the separating roller 4*a* separates and feeds the sheets on the stacker 1. After the sheet is separated and transported to the second transport device 5, the separating roller 4*a* stops so that a next sheet is not picked up. Accordingly, when the first transport device 4 and the second transport device 5 are arranged on separate sheet guides for separating and holding the sheet, respectively, the first and second transport devices 4 and 5 may rotate in a same direction to transport the sheet.

The double feed detection device 6 and sheet edge detection devices 7 are arranged between the first transport device 4 and the second transport device 5. The double feed detection device 6 is composed of the ultrasonic wave sensors, i.e., a pair of a wave sending element 6*a* and a wave receiving element 6*b*. The ultrasonic wave sensors are arranged at opposite positions with the sheet moving along the sheet guide 3 in between. As shown in the drawings, the ultrasonic wave sensors are arranged with an angle between 30 degrees and 45 degrees relative to a normal line N-N perpendicular to a sheet travel surface (described below; see FIG. 2).

The sheet edge detection devices 7 are composed of an optical sensor such as a photo diode, i.e., a light emitting element and a light receiving element arranged at opposite positions with the sheet in between. The double feed detection device 6 and the sheet edge detection devices 7 are arranged between the first transport device 4 and the second transport device 5 in this order at a distance L2 and a distance L3 from the first transport device 4, respectively.

As shown in FIG. 2, the double feed detection device 6 is formed of the ultrasonic wave sensors, i.e., the wave sending element 6*a* and the wave receiving element 6*b* with a same structure. In each of the ultrasonic wave sensors, a piezoelectric diaphragm 9 such as a piezoelectric ceramic plate is embedded in a resilient plastic 10 filled in a case 8 made of metal. Electrodes are formed on front and back surfaces of the piezoelectric diaphragm 9 with deposition to supply high frequency power from lead wires 11.

The piezoelectric diaphragm 9 contacts the case 8 to vibrate together as one body. One end of the lead wires 11 is grounded to the case 8. When the high frequency power is supplied from the lead wires 11 on the wave sending element 6*a*, the piezoelectric diaphragm 11 and the case 8 vibrate at a predetermined frequency for emitting ultrasonic waves. Conversely, the piezoelectric diaphragm 9 is unitized with the case 8 in the wave receiving element 6*b* and resonates upon receiving ultrasonic waves. Electrical energy is thus generated in the piezoelectric diaphragm 9, and is output from the lead wires 11.

The ultrasonic wave sensors are arranged on the sheet guide 3 as the double feed detection sensors 6 connected to an oscillating circuit 12 and a receiving circuit 13 as shown in FIG. 3. The oscillating circuit 12 is composed of a high-frequency wave oscillating circuit 12*a* and a power amp circuit 12*b*. The receiving circuit 13 is composed of an amp circuit 13*a* formed of a transistor and a smoothing circuit 13*b*.

A high-frequency voltage, for example 30 KHz to 400 KHz, is generated in the high frequency wave generator circuit 12*a*. The high-frequency voltage is amplified in an inverter, and supplied to the piezoelectric diaphragm 9 from the lead wires 11 to generate ultrasonic waves. Ultrasonic waves excite the piezoelectric diaphragm 9 on the wave receiving element 6*b* through the sheet and are then output as an electrical signal. The signal output from the wave receiving element 6*b* is amplified by a transistor. After being rectified by the smoothing circuit 13*b*, the signal is smoothed in an integrated circuit such as a capacitor.

Accordingly, when the high-frequency circuit 12*a* is powered up, ultrasonic waves having a predetermined frequency are generated in the piezoelectric diaphragm 9 on the wave sending element 6*a*. As shown in FIG. 2, the piezoelectric diaphragm 9 emits ultrasonic waves at a high frequency having constant amplitude LV1. Ultrasonic waves pass through the sheet and are received by the wave receiving element 6*b* arranged opposite to the wave sending element 6*a*. As a result, the piezoelectric diaphragm 9 on the wave receiving element 6*b* resonates, thereby outputting the electrical energy generated by the vibration. As shown in FIG. 2, ultrasonic waves are attenuated differently to amplitude LV2 when passing through a single sheet, or to amplitude LV3 when passing through two or more sheets.

Figure 5A:
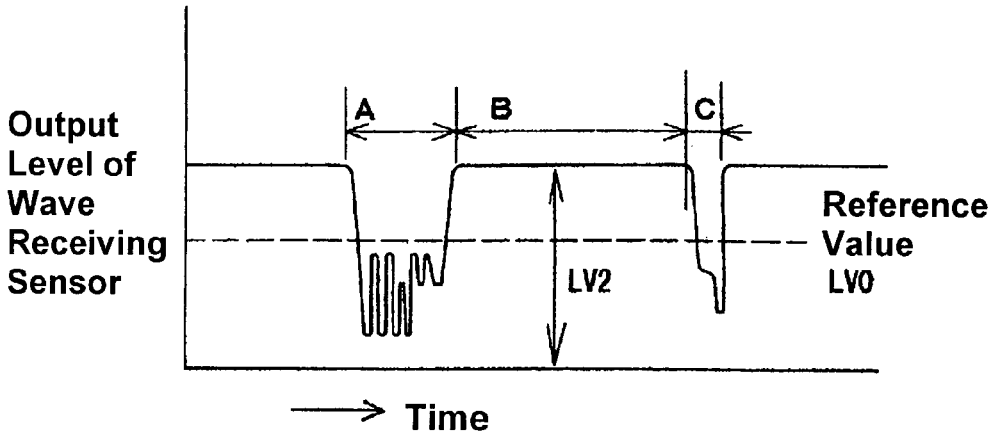
FIGS. 5(*a*) and 5(*b*) are graphs showing waveforms of output signals from the ultrasonic wave sensor shown in FIG. 2.
Figure 5B:
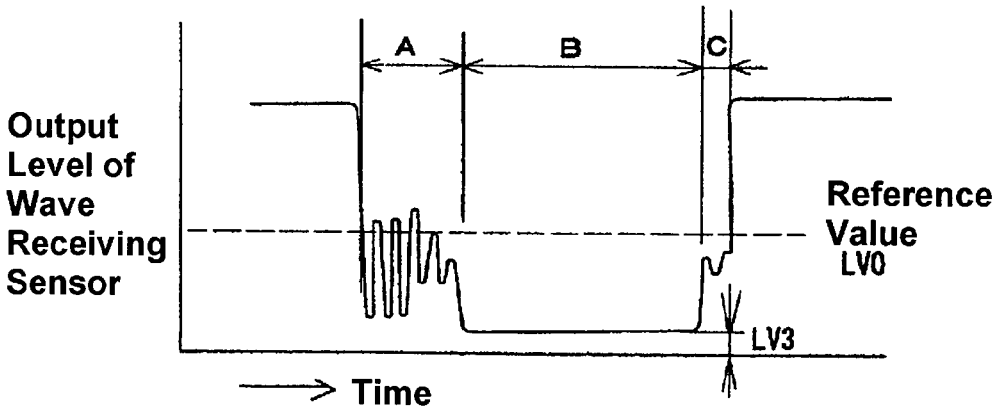

The electrical energy having the waveforms with the amplitude LV2 and LV3 is processed in the amp circuit 13*a* and the smoothing circuit 13*b*. That is, after the electrical energy having the waveforms from the wave receiving element 6*b* is amplified and rectified in the smoothing circuit 13*b* composed of an integrated circuit, the electrical energy has various output levels as shown in FIGS. 5(*a*) and 5(*b*). The output level is compared with a reference value L0 in a comparison device such as a comparator. FIG. 5(*a*) shows an output level LV2 corresponding to a single sheet. The detected value is disturbed in a portion A just prior to when a leading edge of the sheet reaches a pair of register rollers 5*a* and 5*b*. The detected value becomes stable in a portion B when the sheet is nipped by the separating roller 4*a* and the pair of register rollers 5*a* and 5*b*. The detected valued is disturbed again in a portion C when the trailing edge of the sheet is released from the separating roller 4*a* (the sheet passes the roller positions).

Figure 4:
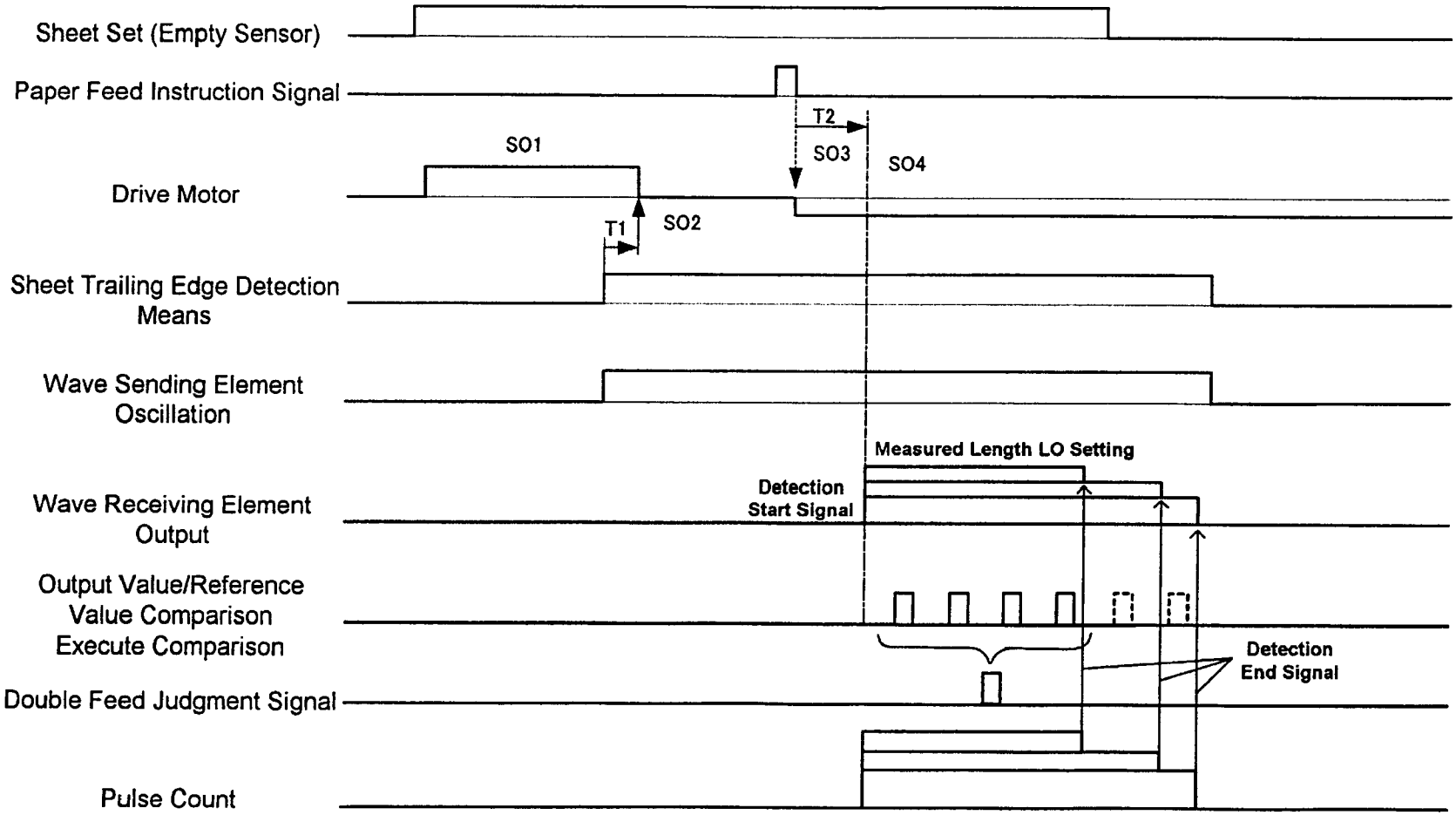
FIG. 4 is a timing chart showing a control of the sheet feeding apparatus shown in FIG. 1.

FIG. 4 is a timing chart of an operation of the sheet feeding structure shown in FIG. 1, and a control circuit is shown in FIG. 3. When the sheets are stacked on the stacker 1, the control unit composed of a control CPU 14 starts a drive motor M of the transport devices 4 and 5 in the forward direction at the sheet signal detected by a empty sensor 117 (S01). With the drive of the drive motor M, the separating roller 4*a* of the first transport device 4 rotates in a clockwise direction. The pair of register rollers 5*a* and 5*b* of the second transport device 5 is in a stopped state. The rotation of the separating roller 4*a* kicks out the sheet on the stacker 1 to the left side in FIG. 1, and the sheet travels through the sheet edge detection device 7 until it reaches the pair of register rollers 5*a* and 5*b*.

Next, the sheet edge detection sensor 7 starts the timer T1 when it detects the leading edge of the sheet (S02). The timer T1 issues a stop signal after the leading edge of the sheet arrives at the pair of register rollers 5*a* and 5*b*, and the separating roller 4*a* continues to rotate to form a predetermined loop in the sheet, then the drive motor M stops.

When the paper feed instruction signal is issued from a processing apparatus such as an image reading apparatus (S03), the drive motor M rotates in reverse. Simultaneously, the timer T2 is started. Also, the control CPU 14 turns on the generator circuit 12 for the ultrasonic wave sensors at the paper feed instruction signal (S03). The pair of register rollers 5*a* and 5*b* rotates in the clockwise direction with the reverse rotation of the drive motor M to feed the sheet to the processing platen 2. At this time, the separating roller 4*a* is stopped. The timer T2 issues the double feed detection start signal (S04) after the loop in the leading edge of the sheet is removed. Then, the sheet is supported in a straight line by the separating roller 4*a* and the pair of register rollers 5*a* and 5*b*. Note that the timers T1 and T2 are both composed of delay circuits that count a reference clock of the control CPU 14 using a counter.

Upon receiving the paper feed instruction signal S03 from the main unit, the control CPU 14 monitors a status of the size sensor 50 of the stacker 1 and recognizes the length of the sheets stacked on the stacker 1. The sheet length recognition device 49 stores the length of the sheet corresponding to a position of the sheet on the stacker 1 or a standard size in a memory table on the ROM 52, and recognizes the length of the sheet stacked on the stacker 1 or the standard size when the size sensor 50 sends a signal indicating that there is the sheet or not.

A variety of configurations can be used for the sheet length recognition device 49. It is necessary to select whether to recognize the sheet length in the transport direction as an actual measured value, or to recognize a predetermined standard size of sheet. The latter configuration is more convenient, and thus the following explanation will describe the configuration. The control CPU 14 determines the measurement length of the double feed detection device 6 based on the standard size of the sheet stacked on the stacker 1.

As shown in FIG. 1, when a measurement length L0 for the sheets with different lengths is determined relative to a position of the double feed detection device 6, a length L5 in the transport direction (downstream) is determined from a position of the register roller 5*a* and an extended length of the loop shape (formed by the timer T1) into a straight line. Accordingly, the length L5 is determined according to a layout configuration regardless of the length of the sheets, and the length L5 at the leading edge of the sheets becomes a non-detection region. Another non-detection region L4 is formed at the trailing edge of the sheets as a length greater than a distance L2 between the first transport device 4 and the double feed detection device 6. The non-detection region L4 is greater than the distance L2, so that it is possible to prevent the double feed detection device from detecting when the trailing edge of the sheet is released from the first transport device 4 and is flapping.

The measurement length L0 is determined with a first method in which a plurality of measurement lengths is set according to sheet sizes, and the measurement length is selected according to the recognized size; or a second method in which the length in the transport direction is set according to a sheet size, and the measurement length is calculated from the length corresponding to the recognized size. In a case of the first method, a plurality of measurement lengths L0 corresponding to the standard sizes is stored in the ROM 52 on the CPU 14 as a memory table. One of the data is retrieved when the size sensor 50 sends a signal. In a case of the second method, the sheet lengths are stored in the ROM 52 on the CPU 14 and one of the data is retrieved. The control CPU 14 subtracts L5 and L4 from the selected one of the sheet lengths. L4 is set to be a sum of the distance L1 between the first transport device 4 and the double feed detection device 6 and an error (a; for example 10 mm) such as irregular transportation (L4=L1+a).

As shown in FIG. 4, the control CPU 14 starts the oscillating circuit 12 of the ultrasonic wave sensor when it receives the double feed detection start signal S04. The oscillating circuit 12*a* continuously or intermittently sends a specified frequency to the wave sending element 6*a*. Ultrasonic waves are received on the wave receiving element 6*b* facing the wave sending element 6*a* after passing through the sheet. The resulting signal corresponding to a status of the sheet is output as the energy through the amp circuit 13*a* and the smoothing circuit 13*b*. The output value is compared to a preset value by the comparator circuit 13*c*.

Specifically, the electrical energy of the vibration waveform output from the wave receiving element 6*b* is amplified and rectified. Then, the energy is converted to the output levels shown in FIGS. 5(*a*) and 5(*b*) by the smoothing circuit 13*b* composed of an integrated circuit and compared to a reference value by a comparison device such as a comparator.

FIG. 5(*a*) shows the output level when a single sheet is transported. The detected value is disturbed in the portion A just prior to when the leading edge of the sheet reaches the pair of register rollers 5*a* and 5*b*. The detected value becomes stable in the portion B when the sheet is nipped by the separating roller 4*a* and the pair of register rollers 5*a* and 5*b*. The detected value is disturbed again in the portion C when the trailing edge of the sheet is released from the separating roller 4*a* (the sheet has passed the roller positions). FIG. 5(*b*) shows the output level when two sheets are transported. The portions A, B, and C in the drawing represent the same conditions described above.

By setting the standard level indicated by hidden line in the drawings, it is possible to judge the single sheet shown in FIG. 5(*a*) or the double feed shown in FIG. 5(*b*) with the output results of the comparator. The reference value is determined in the following way. Initially, the conditions such as paper thickness, paper quality, and transport speed are determined based on the usage environment of the apparatus. Then, boundary values of the output levels for the wave receiving sensor are determined through testing based on the conditions for the single sheet and two or more sheets. The value is used to set the reference value. The energy is output from the wave receiving element 6*b* as an analog signal. Accordingly, when the energy is amplified, it is rectified by a diode and smoothed by a smoothing circuit such as a capacitor. Then, the detected voltage level is compared with the reference value.

The oscillating circuit 12*a* may instantaneously apply the high-frequency voltage to the wave sending element 6*a* to cause burst waves, or may continuously apply the electrical power to cause continuous waves. Either of these can be employed on the wave sending element 6*a*.

In either case, it is preferred that the output data is grouped and sequentially compared with a reference value for each group for the overlapping of sheets by the comparator circuit 13*c*. The results are accumulated in a buffer for an overall judgment. Because the output from the wave receiving element 6*b* is unstable (easily changed with environmental conditions) for the double feed, it is preferred to detect the double feed by detecting a plurality of continuous burst waves. When ultrasonic waves are continuously sent from the oscillating circuit 12*a*, it is preferred that output data from the smoothing circuit 13*b* is grouped by a reference clock such as the CPU. It is compared sequentially with reference values by the comparator circuit 13*c*, and the results are accumulated in a buffer memory to sequentially judge the double feed of the sheets for each group.

The timer T2 sets an estimated time for the second transport device 5 to send the sheet for the length L5 to start the double feed detection when the timer T2 stops. Ultrasonic waves are sent to the wave receiving element 6*b* when the power is on and stable at the wave sending element for the double feed detection, and the detection data from the comparator circuit 13*c* is accumulated in the buffer. As the data before the time up of the timer T2 is unnecessary, the control CPU clears the data in the buffer at the time of the timer T2. When this occurs, the data compared by the comparator circuit 13*c* is sequentially sent to the buffer while the sheet is moved by the second transport device 5. The control CPU 14 calls up the comparison data to monitor the double feed of the sheets.

When the timer T2 expires, the control CPU 14 detects an amount of the sheet feed of the second transport device 5 that is equivalent to the measurement length L0. As shown in FIG. 3, the drive motor M is composed of a stepping motor. Power 56 is applied to the drive circuit 54 from a pulse generator 55. A counter 57 of a flip-flop circuit is mounted to a pulse generator 55. The counter 57 counts the number of rotations of the stepping motor M. The control CPU stops the double feed detection when the count matches the selected measurement length L0 (ROM 52), and ends the reading of comparison data from the register 53.

The double feed of the sheets is detected in the optimum detection region according to the length of the sheet. When the control CPU 14 receives the status signal from the register 53 indicating that the sheets are overlapped, it issues a double feed signal to the main unit such as an image reading apparatus, to display a warning or interrupt the processing of the sheet to allow the operator to take a necessary recovery step.

Next, in the double feed detection method according to the present invention, the control CPU 14 judges the double feed of the sheets using the following steps.

Step 1

The length of the sheet in the transport direction is recognized from the status signal of the size sensors 50 arranged on the stacker 1, when the paper feed instruction signal is received from the main apparatus, as described above.

Step 2

The measurement length region is set based upon the sheet length recognized that step 1. The corresponding data is called up from the memory table stored in the ROM 52. Note that the data stored in the ROM 52 includes a sheet length value data, a plurality of measurement length value data that corresponds to sheet sizes, or corresponding pulse counts (time).

Step 3

The double feed of the sheets is detected over the measurement length region set at step 2. The signal output from the wave receiving element 6*b* is amplified, rectified, and smoothed. Then, the signal is compared by the comparator circuit 13*c* to judge whether the sheets are the double feed or a non-double feed by the signal of the register 53. The sheet is repeatedly transported until the measurement length set at step 2 is obtained.

Step 4

The results of the judgment of the double feed at step 3 are sent to the main unit, such as an image reading apparatus.

Figure 6:
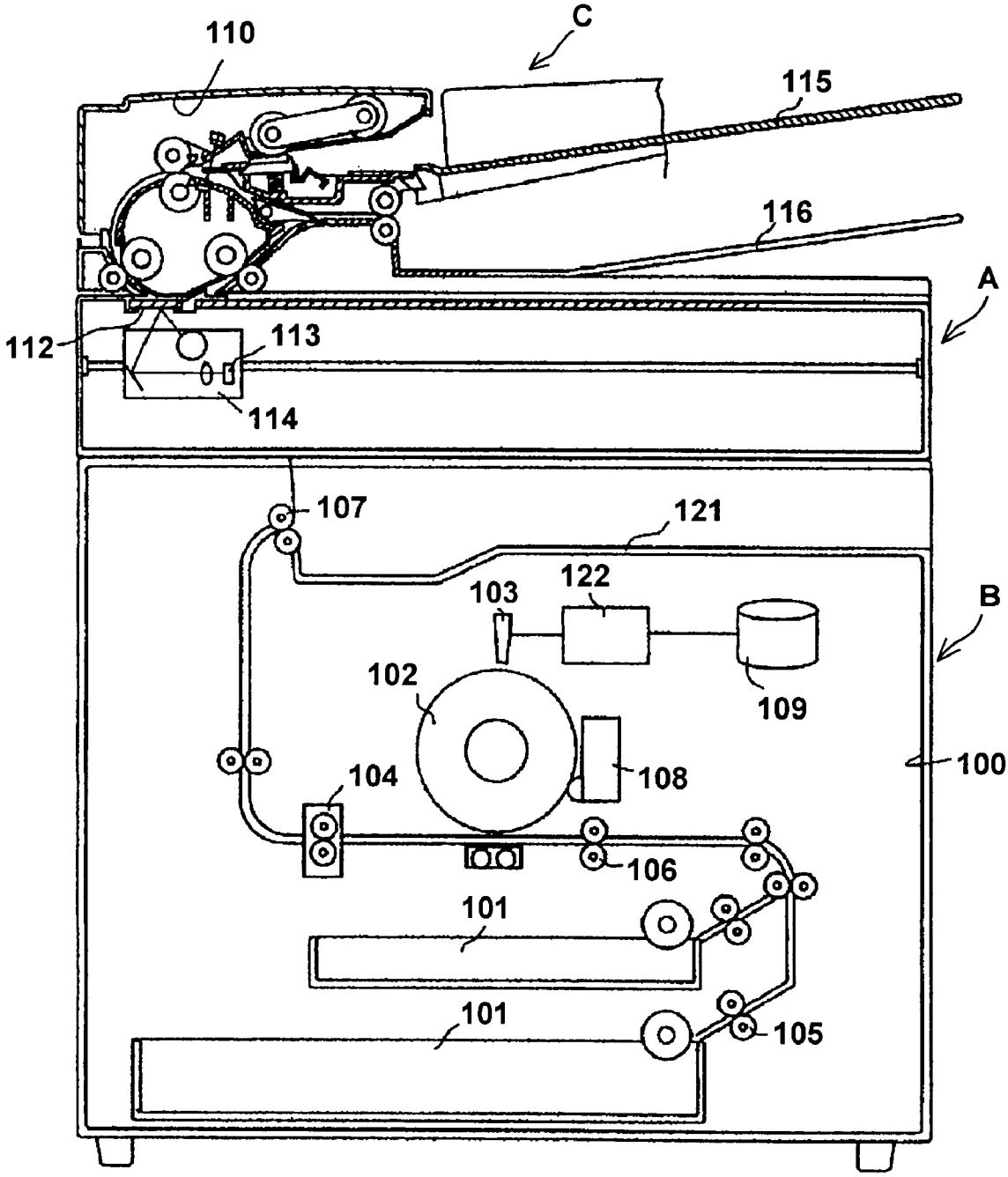
FIG. 6 is a view showing an image reading apparatus and an image forming apparatus equipped with the same as a unit according to an embodiment of the present invention.
Figure 7:
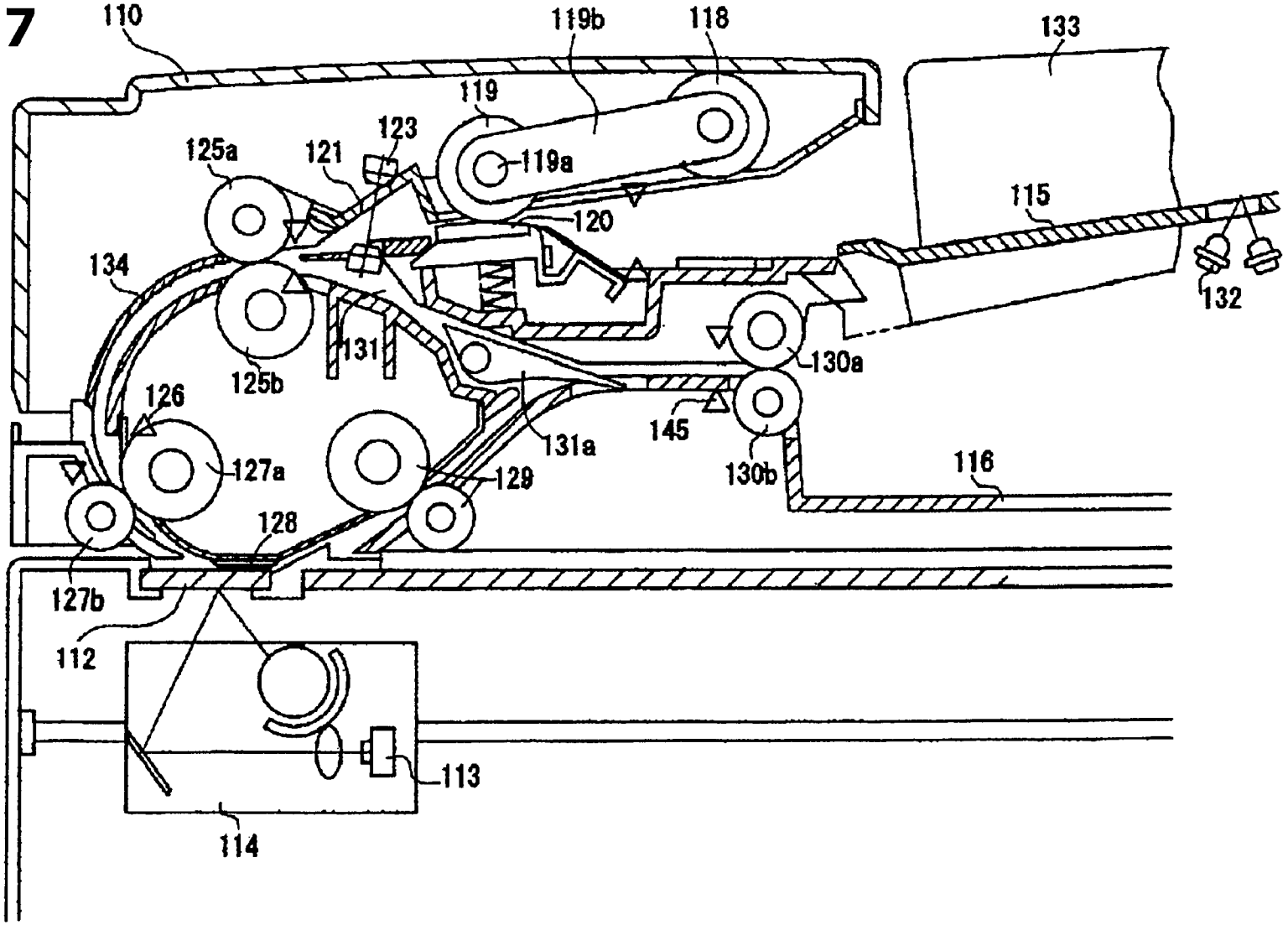
FIG. 7 is a view showing a sheet supply unit of the image forming apparatus shown in FIG. 6.

An image reading apparatus according to an embodiment of the present invention will be explained next. FIG. 6 shows an image reading apparatus A and an image forming apparatus B mounted with the image reading apparatus A as a unit. FIG. 7 shows a sheet feeding unit in the image forming apparatus B. The image forming apparatus B mounted with the image reading apparatus A is embedded with a print drum 102 inside the casing 100; a paper cassette 101 that feeds paper to the print drum 102; a developer 108 that forms images using toner on the print drum 102; and a fixer 104. A print head 103 such as a laser forms latent images on the print drum 102. Paper fed from the paper feed cassette 101 is sent by the transport rollers 105 to the print drum 102, and the images formed by the print head 103 are transferred to the sheet and then fixed thereupon by the fixer 104. The sheet with images is stored in the discharge stacker 121 from the discharge roller 107.

The image forming apparatus B is widely known as a printer, and composed of a paper feed unit, a printing unit and a discharge storage unit. Their functions are various and are not limited to the structure described above. For example, it is perfectly acceptable to employ an inkjet printer, or a silk-screen printer.

A data control circuit 109 is electrically connected to the print head 103 to sequentially transfer image data accumulated by the memory apparatus 122 such as a hard disk for accumulating image data to the print head. On the upper portion of the image forming apparatus B, the image reading apparatus A is mounted as a unit. The image reading apparatus A is mounted with the platen 112 on the casing 110. An optical mechanism 114 and a photoelectric converting element 113 are arranged to read the original through the platen. A CCD is widely known and used for the photoelectric converting element 113.

As shown in FIG. 7, the sheet feeding apparatus C is installed on the platen 112. Above the platen 112 are arranged a paper feed stacker 115 and a discharge stacker 116 above each other on the sheet feeding apparatus C. The sheets from the paper feed stacker 115 are guided to the discharge stacker 116 via the U-shaped transport path 134 after traveling over the platen 112. Arranged on the paper feed stacker 115 are an empty sensor 117 for detecting the sheets on the stacker, and a size sensor 132. As shown in the drawing, a side guide 133 aligns the side edges of the sheets. The size sensor 132 and the side guide 133 are described in further detail below with reference to FIG. 8.

Arranged at a downstream side of the paper feed stacker 115 are a separating roller 119 and a stationary roller 120 in contact with the roller. A kick roller 118 is mounted on the bracket 119*b* mounted on the rotating shaft 119*a* of the separating roller 119. When the rotating shaft 119*a* rotates in the clockwise direction, the kick roller 118 lowers to above the paper feed stacker 115. Conversely, when the rotating shaft 119*a* rotates in a counterclockwise direction, the kick roller 118 rises to a state shown in the drawing. The mechanism is described in further detail below. At a downstream side of the separating roller 119 are a double feed detection sensor 123 that detects the double feed of the sheets, and a sheet edge detection device 124 that detects the leading edge and the trailing edge of the sheet. These are arranged in the transport path 134.

Also, equipped in order on the transport guide 134 are register rollers 125*a* and 125*b*; feed rollers 127*a* and 127*b*; a transport roller 129; and a discharge roller 130. These are sequentially arranged to transport the sheets from the paper feed stacker 115 to the discharge stacker 116.

As shown in the drawing, a lead sensor 126 detects the leading edge of the sheet. A guide 128 supports the sheets at the platen 112 position. A circulating path 131 circulates the sheets from the platen 112 to the register rollers 125*a* and 125*b* through a path switching gate 131*a*.

Next, the side guide 133 and the size sensor 132 will be explained. A pair of the side guides 133 (133*a* and 133*b*) is disposed on the left and right sides of the paper feed stacker 115 to control the side edges of the sheets. The side guides are movably mounted in the width direction of the sheets. The racks 135 and 136 are integrally mounted to the left and right guides 133*a* and 133*b*. These mate with the pinion rotatably fixed to the paper feed stacker 115.

The left and right guides 133*a* and 133*b* are moved in the opposite directions for the same amount by a pinion 137. The detection piece 139 composed of a protrusion at a position that corresponds to the size of the sheets is disposed on one of the racks 136. The position of the detection piece 139 is detected by the position sensor 138 mounted to the bottom of the stacker 115. The position sensor is composed of a slidac volume and can detect the position of the side guide 133 by detecting the variation in the resistance value varying with the length of engagement with the detection piece 139. Furthermore, size sensors 132 are disposed in plurality on the stacker 115 to detect the trailing edge of the sheet.

The position sensor 138 detects the width direction of the sheets on the stacker 115, and with the judgment by the size sensor 132 for the sheets having the same width, the size of the sheet on the stacker 115 can be detected.

Figure 9A:
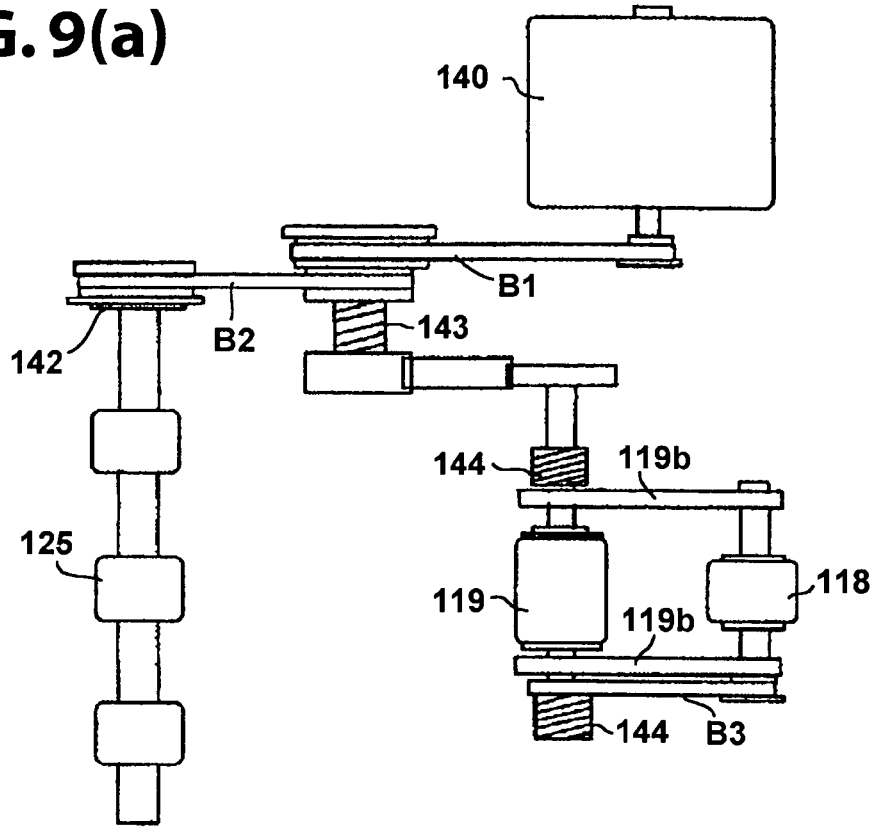
FIGS. 9(*a*) and 9(*b*) are views showing drive mechanisms of the sheet supply unit shown in FIG. 7.
Figure 9B:
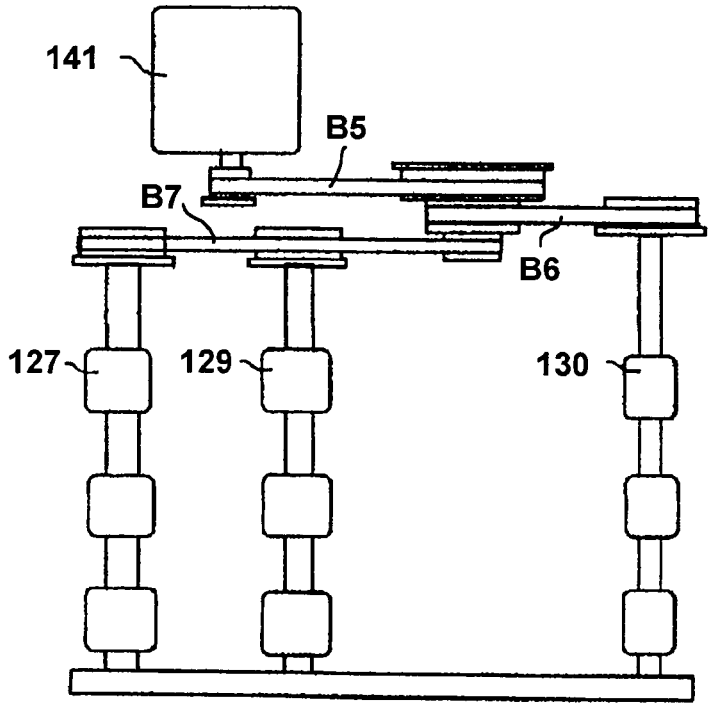
Figure 11A:
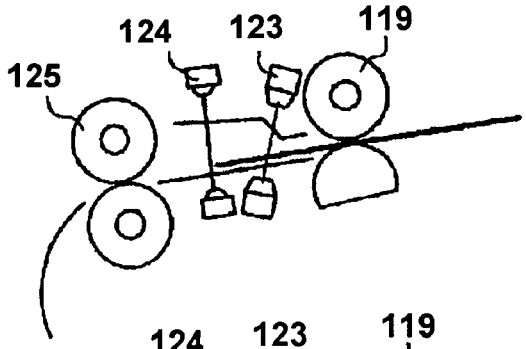
FIGS. 11(*a*) to 11(*e*) are views showing an operation of feeding a sheet in the image forming apparatus shown in FIG. 6.
Figure 11B:
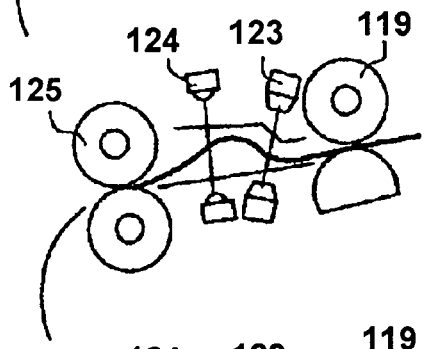
Figure 11C:
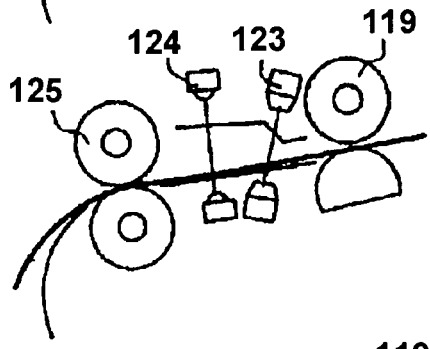
Figure 11D:
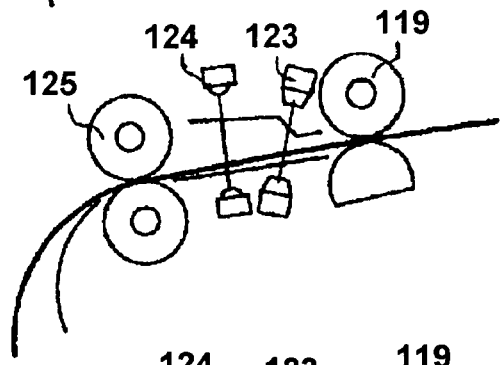
Figure 11E:
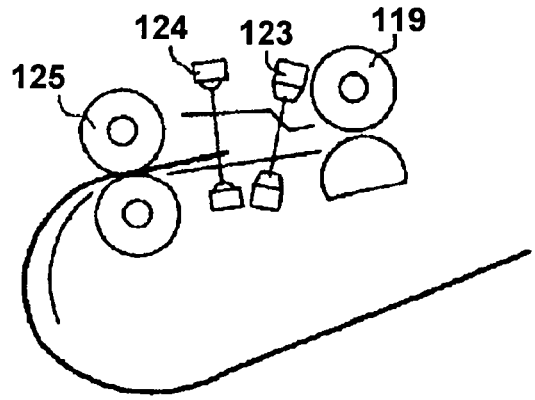

FIGS. 9(*a*) and 9(*b*) show a drive mechanism of the separating roller 19 and the register rollers 125. The paper feed drive motor 140 capable of both forward and reverse rotations drives the kick roller 118, the separating roller 119, and the register rollers 125. The transport drive motor 141 drives the paper feed roller 127, the transport out roller 129, and the discharge roller 130. With the forward rotation, the paper feed drive motor 140 drives the kick roller 118 and the separating roller 119. With the reverse drive, it drives the register roller 125. Simultaneously, the paper feed drive motor 140 controls the rising and lowering of the kick roller 118. Force from the paper feed drive motor 140 is transmitted to the register rollers by a one-way clutch 142 via belts B1 and B2 only in one direction of rotation. At the same time, the paper feed drive motor is connected to a rotating shaft of the separating roller 119 by the one-way clutch 143 to transmit drive relatively with the one-way clutches 142 and 143.

The bracket 119*b* is supported on the rotating shaft of the separating roller 119 via the spring clutch 144. Drive is transmitted to the kick roller 118 mounted on the bracket 119*b* by the transmission belt B3. When the paper feed drive motor 140 rotates in the forward direction, rotating drive is transmitted to the separating roller 119 and the kick roller 118. Simultaneously, the spring clutch 144 is released so that the bracket 119*b* becomes free and lowers from an idled and raised position shown in FIG. 7 and the kick roller 118 touches the sheet on the stacker. Rotating the paper feed drive motor 140 in the reverse direction transmits drive to the register rollers 125. Simultaneously, the spring clutch 144 contracts thereby raising the bracket 119*b* to return to the idled position shown in FIG. 1.

The transport unit drive motor 141 is connected to the feed rollers 127, transport rollers 129, and discharge rollers 130 via the belts B5, B6 and B7. The feed rollers 127 and transport rollers 129 always rotate in one direction with the forward and reverse rotations of the motor with the one-way clutch. The discharge rollers 130 rotate forward and in reverse with the forward and reverse rotations of the motor.

Sensors for detecting the leading edge of the sheets are arranged in the transport path 134. Their functions will be explained. The size sensors 132 that detect the size of the sheets set on the paper feed stacker 115 are arranged in plurality. These detect the size of the sheets to control sheet transport. The empty sensor 117 is disposed on the leading edge of the paper feed stacker 115 to detect the sheets on the stacker. This detects the transport of the final sheet and sends a signal to the processing apparatus, such as the image reading apparatus A. At a downstream side of the separating roller 119 are disposed the double feed detection sensor 123 described above and the sheet edge detection sensor 124.

A lead sensor 126 is disposed in front of the paper feed roller 127. This relays the leading edge of the sheet to the image reading apparatus for reading images and calculates the starting line for printing. Simultaneously, if the sheet is not detected after a predetermined amount of time from the paper feed instruction signal from the register roller 125, the drive motor stops because of a jam and issues a warning signal. At a downstream side of the transport rollers 129 is disposed the discharge sensor 145 to judge jams by detecting the leading-edge and the trailing edge of the sheets.

The following will outline an operation of the apparatus described above. FIG. 10 shows a flow chart of the operation. The apparatus is turned on and the sheets are placed in the paper feed stacker 115. By setting sheets, the empty sensor 117 detects the sheets and starts the paper feed drive motor 140 (ST100).

With the rotation of the paper feed drive more 140, the kick roller 118 and separating roller 119 separate the sheets and kick them out. They are fed to the transport guide 128 between the separating roller 119 and the transport rollers 125. The sheet edge detection device 124 (hereinafter referred to as sensor 124) detects the leading edge of the sheets (ST101). The timer T1 activates after the detection signal of the leading edge of the sheet (see FIG. 4) to stop the motor 140 after a predetermined amount of time (ST102).

According to the operation shown in FIG. 11(*a*), the sensor 124 detects the leading edge of the sheet and activates the timer T1. Next, in FIG. 11(*b*), the leading edge of the sheet strikes the register rollers 125, and a loop is formed in the sheet. In this state, a set amount of time for the timer T1 ends and the motor 140 stops. When the paper feed instruction signal is generated from the control unit of the image reading apparatus A, the motor 140 starts rotating again in the reverse direction. Also, with the paper feed instruction signal, the timer T2 is activated. With the timer T2 (see FIG. 4), the registration loop is removed and the sheet is supported between the separating roller 119 and the register rollers 125 in a straight line as shown in FIG. 11(*c*) (ST104).

Next, as shown in FIG. 11(*d*), until the trailing edge of the sheet is released from the separating roller 119, the double feed detection sensor 123 detects the double feed of the sheets (ST105). The trailing edge of the sheet transported in that way is detected by the sensor 124 (ST106). Approximately about the time when the trailing edge of the sheet is detected, the lead sensor 126 detects the leading edge of the sheet, and the feed roller 127 feeds the sheet toward the platen 112 (ST107).

When the leading edge is detected by the lead sensor 126 and the sheet reaches the platen 112, the reading process is executed as electrical signals by the optical mechanism 114 and the photoelectric converting element 113 (ST108). After the sheet is read, it is discharged to the discharge stacker 116 by the transport rollers 129 and the discharge rollers 130. The discharge of the sheet is detected by the discharge sensor 145 (ST109).

The transport direction and the width direction of the sheets stacked on the paper feed stacker 115 are detected by the size sensor 132 and the position sensor of the side sensor 133 in the process. Thus, the length size of the sheet is recognized. The same type of encoder and counter shown in FIG. 1 are arranged on the paper feed drive motor 140 that drives the register roller 125 to detect the amount of rotation of the motor. These detect the transport direction length of the sheet transported with the register roller 125. When the transport length matches the measurement length set by the length size of the sheet, the output signals from the double feed detection sensor 123 are reset.

The following shall describe another embodiment of the invention in reference to FIGS. 12 to 15. Components in the drawings same as the apparatus of the embodiment described heretofore use the same numbers. Thus, explanations for those parts and functions same as those in the embodiment described above refer to the same drawings.

Figure 12:
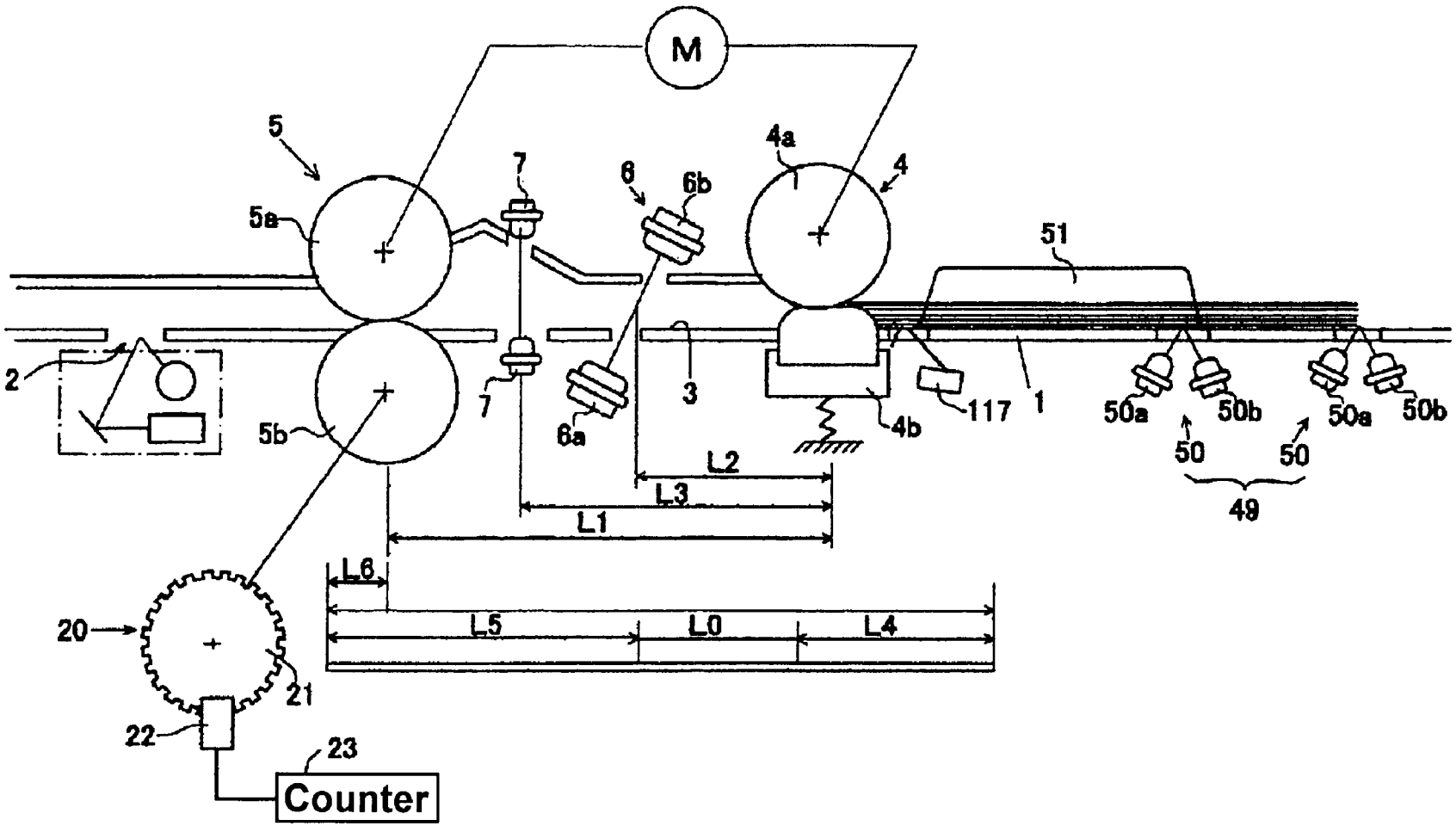
FIG. 12 is a schematic view of a sheet feeding apparatus according to another embodiment of the present invention.

The apparatus shown in FIG. 12 is equipped with a stacker 1 for storing sheets; a transport guide 3 for guiding the sheets from the stacker 1 to the processing platen 2; at least two transport devices of the first and second transport devices 4 and 5 arranged on the transport guide 3; and a double feed detection device 6 arranged between the first transport device 4 and the second transport device 5 for detecting the double feed of the sheets. The stacker 1 is composed of a tray that stacks the sheets. A sheet size recognition device 49 is disposed on the stacker 1 for detecting the length of the sheets in the transport direction.

Between the first and the second transport devices 4 and 5 are arranged the double feed detection device 6, the sheet edge detection device 7, and a sheet transport direction length detection device 20. The double feed detection device 6 is composed of the ultrasonic wave sensors. They are a pair of a wave sending element 6*a* and a wave receiving element 6*b*. These are arranged at opposite positions and interposed by the sheets that travel along the transport guide 3.

The double feed detection device 6 is arranged at the distance L2 from the first transport device 4 between the first and the second transport devices (a distance L1), and the sheet edge detection device 7 is arranged at a distance L3 from the first transport device. The sheet transport direction length detection device 20 can employ either of the following detection methods to detect the transport direction length of the sheet fed by the first and second transport devices. (1) An amount of rotations of one of the first or the second transport device is detected; (2) the transport device drives at a constant speed and the amount of rotations of the transport device is calculated from a drive time, or if using a stepping motor, count the number of drive pulses; and (3) a floating roller engages the sheet moved by the first and the second transport devices and an encoder detects the amount of rotations of the floating roller.

An encoder 21 is formed of slits with an equal gap therebetween on an outer perimeter of a rotating shaft of the register roller 5*b*, as shown in the drawing. The slits are detected by an encoder detection sensor 22 such as a photo coupler. By measuring signals from the encoder detection sensor 22 by a counter 23, the amount of rotations of the register roller 5*b* can be measured. The drawing shows an example of calculating the length of transfer of the register roller 5*b* using the amount of rotations. Therefore, the counter 23 is started when the sheet edge detection sensor 7 detects the leading edge and the leading edge of the sheets nipped by the register rollers 5*a* and 5*b* after a predetermined timer. By stopping the counter 23 after the sheet edge detection sensor 7 detects the trailing edge of the sheet, and an estimated amount of time (timer time) for the trailing edge of the sheet to reach the nipping point of the register rollers 5*a* and 5*b*, the transport length from the leading edge to the trailing edge of the sheet is detected.

The double feed detection device 6 is shown in FIG. 2, and any further description is omitted. In this embodiment, the ultrasonic wave sensor is arranged on the transport guide 3 as the double feed detection sensor 6 and is connected to the oscillating circuit 12 and the receiving circuit 13 as shown in FIG. 3. The oscillating circuit 12 is composed of the high-frequency wave oscillating circuit 12*a* and the power amp circuit 12*b*. The receiving circuit 13 is composed of the amp circuit 13*a* composed of a transistor and smoothing circuit 13*b*. High-frequency voltages (for example 30 KHz to 400 KHz) of 200 KHz are generated in the embodiment by the high frequency wave generator circuit 12*a*, and the signal is amplified by an inverter. The piezoelectric diaphragm 9 is charged from the lead wire 11 to generate ultrasonic waves at the piezoelectric diaphragm 9.

Ultrasonic waves excite the piezoelectric diaphragm 9 on the wave receiving element through the sheet and are then output as electrical signals. Signals input from the wave receiving element 6*b* are amplified by a transistor. After being rectified by the smoothing circuit 13*b*, they are smoothed by an integrated circuit such as a capacitor.

Therefore, when power is supplied to the high-frequency circuit 12*a*, ultrasonic waves having a predetermined frequency are generated by the piezoelectric diaphragm 9 on the wave sending element 6*a*. The diaphragm 9, as shown in FIG. 2, emits ultrasonic waves at a high frequency having constant amplitude LV1. Ultrasonic waves pass through the sheet and are received by the wave receiving element 6*b* arranged opposite to the wave sending element 6*a*. This causes the piezoelectric diaphragm 9 on the wave receiving element 6*b* to resonate, thereby outputting electrical energy generated by the vibration. The attenuation of ultrasonic waves when the sheet passes through is output differently to when there is only one sheet (output level LV2), shown in FIG. 2 and to when there are two or more sheets (output level LV3).

The electrical energy output as waveforms shown in FIG. 2 is processed by the amp circuit 13*a* and the smoothing circuit 13*b*. Specifically, after the electrical energy of the vibration waveform output from the wave receiving element 6*b* is amplified, it is rectified, converted to the output level shown in FIGS. 5(*a*) and 5(*b*) by the smoothing circuit 13*b* composed of an integrated circuit and then compared to a reference value (Level LV0) by a comparison device such as a comparator. FIG. 5(*a*) shows the output level LV2 when a single sheet is transported. The detected value is disturbed in the portion A just prior to when the leading edge of the sheet reaches the pair of register rollers 5*a* and 5*b* and a registration loop is formed. The detected value becomes stable in the portion B when the sheet is nipped by the separating roller 4*a* and the pair of register rollers 5*a* and 5*b*. The detected valued is disturbed again in the portion C when the trailing edge of the sheet is released from the separating roller 4*a* (the sheet has passed the roller positions). FIG. 5(*b*) shows the output level LV3 when two sheets are transported. The portions A, B, and C represent the same conditions described above.

When the reference value is set to the level LV0 indicated by the hidden in this drawing, a relationship of LV1>LV2>LV0>LV3 is shown at the B portion. i.e., the stabilized portion. It is possible to judge with the output results of the comparator that the sheet is a single sheet LV2, or that there are two sheets LV3. The reference value is determined in the following way. Initially, the conditions such as paper thickness, paper quality, and transport speed are determined based on the usage environment of the apparatus. Then, the boundary values of the output levels for the wave receiving sensor are determined through testing based on these conditions for one sheet and two or more sheets. This value is used to set the reference value. The current of the vibration wave form is output from the wave receiving element 6*b* as an analog signal. This is amplified and changed into an integrated value at the integrated circuit, and the detected value and the reference value are compared. Or after amplifying the output value from the wave receiving element 6*b*, it is rectified by a diode. Then, it is smoothed by a smoothing circuit such as a capacitor and the voltage value is compared as the detected value with the reference value.

The oscillating circuit 12*a* can instantaneously apply high-frequency voltage to the wave sending element 6*a* to cause burst waves, or continuously apply electrical power to cause a continuous waves. Either of these can be employed on the wave sending element 6*a*. The output from the wave receiving element 6*b* is unstable (easily changed with environmental conditions) when there is the double feed. Thus, it is preferred to detect the double feed by repeatedly sending a plurality of intermittent single burst waves. When consecutively or intermittently detecting over a specific region of the sheet, the measurement length L0 is determined by forming the non-detection region L5 at the leading edge of the sheet and the non-detection region L4 at the trailing edge of the sheet based on the smallest size of the sheet as shown in FIG. 12.

Specifically, the non-detection length L5 is formed at the leading edge of the sheet, and is greater than the distance (L1−L2) from the second transport device 5 to the double feed detection device 6 (L5≧(L1−L2)). Accordingly, it is possible to start detection while the leading edge of the sheet is nipped by the second transport device 5. The non-detection length L4 is set to be greater than the distance L2 from the first transport device 4 to the double feed detection device 6 (L4≧L2), so that the detection is stopped in a state that the trailing edge of the sheet is nipped by the first transport device 4. The measurement length L0 is set to be equal to (length of the maximum size of sheet)−(L4+L5) in advance, and the double feed is detected consecutively or intermittently over the length. In this case, the wave sending elements 6*a* may emit ultrasonic waves over the length L5 at the sheet leading edge and the length L4 at the sheet trailing edge. Accordingly, the output signals received from the wave receiving element 6*b* are not used for the double feed detection at the sheet leading edge (L5) and the trailing edge (L4).

Figure 13:
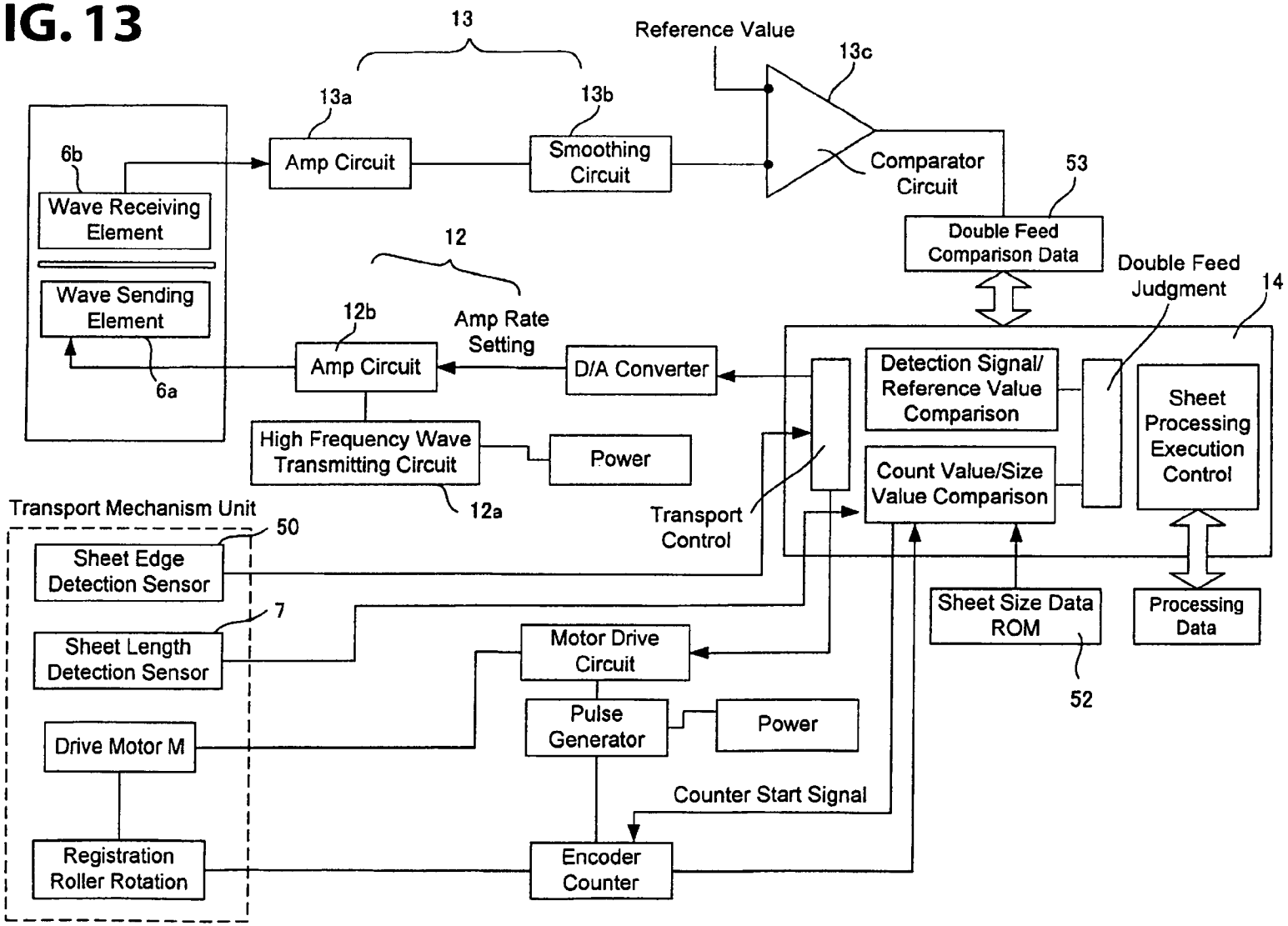
FIG. 13 is a block diagram of a control circuit of the sheet feeding apparatus shown in FIG. 12.
Figure 14:
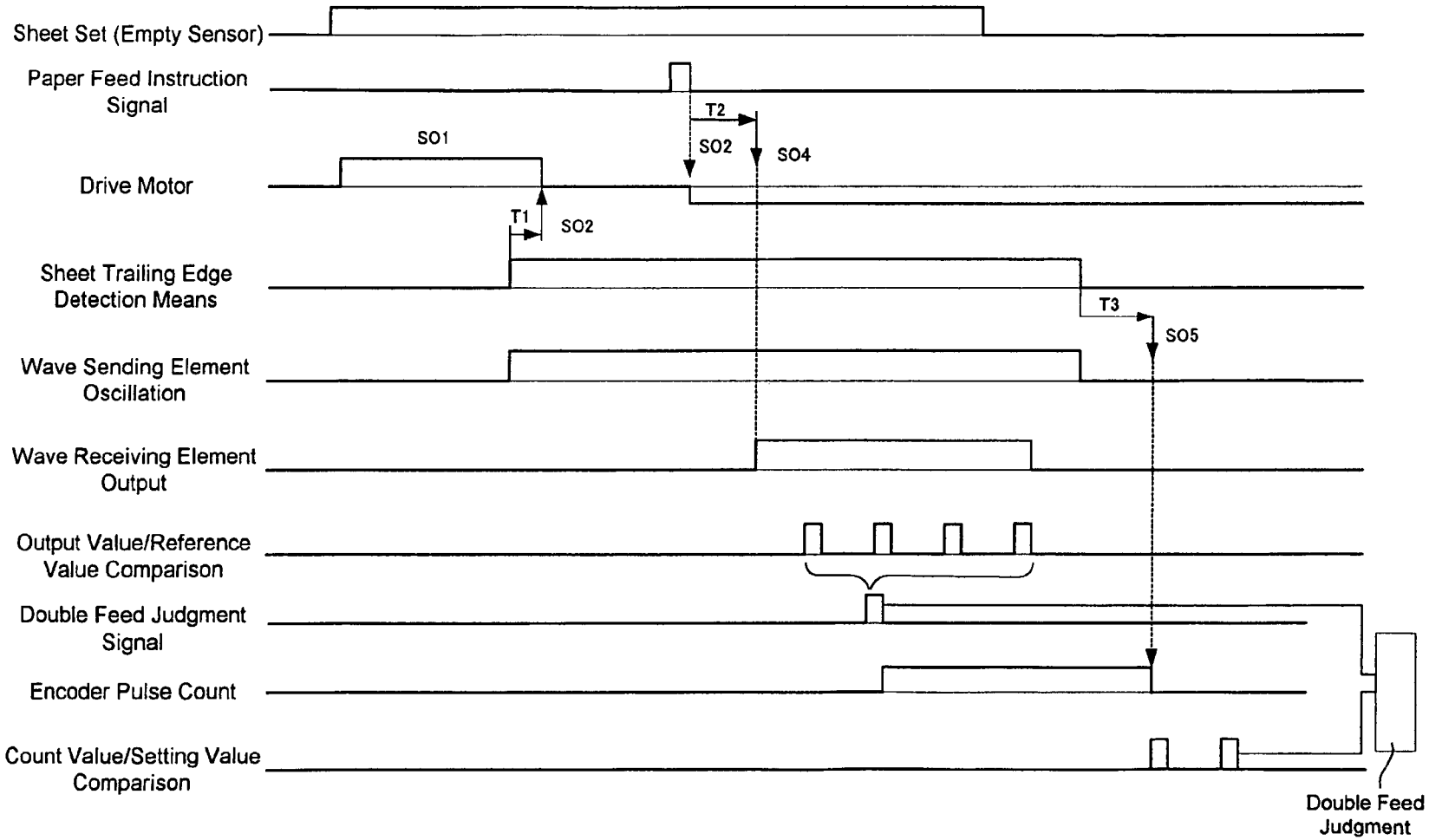
FIG. 14 is a timing chart showing a control of the sheet feeding apparatus shown in FIG. 12.

FIG. 14 is a timing chart of the control circuit shown in FIG. 13, and the timing chart will be described according to a flow chart shown in FIG. 15. When the sheets are stacked on the stacker 1, the control unit composed of the control CPU 14 rotates the drive motor M of the transport devices 4 and 5 in the forward direction at the signal of detecting the sheets by the empty sensor 117 (ST01 in FIG. 15).

With the drive of the drive motor M, the separating roller 4*a* of the first transport device 4 rotates in a clockwise direction. The pair of register rollers 5*a* and 5*b* of the second transport device 5 is in a stopped state. The rotation of the separating roller 4*a* kicks out the sheet on the stacker 1 to the left side in FIG. 12, and the sheet travels through the sheet edge detection device 7 until it reaches the pair of register rollers 5*a*, 5*b*.

Next, the sheet edge detection sensor 7 starts the timer T1 when it detects the leading edge of the sheet (S02). The timer T1 issues a stop signal after the leading edge of the sheet arrives at the register roller 5*a*, and the separating roller 4*a* rotates to form a predetermined loop in the sheet and the drive motor M stops (ST02 in FIG. 15).

Then, by issuing the paper feed instruction signal (S03) from the processing apparatus such as an image reading apparatus, the drive motor M rotates in reverse. Simultaneously, the timer T2 is started. Also, at the same time, the control CPU 14 turns on the generator circuit 12 of the ultrasonic wave sensor at the paper feed instruction signal (503). The pair of register rollers 5*a*, 5*b* rotates in the clockwise direction with the reverse rotation of the drive motor M to feed the sheet to the processing platen 2. At this time, the separating roller 4*a* is stopped. The timer T2 issues the double feed detection start signal (S04) after the loop in the leading edge of the sheet is removed, and the sheet is supported in a straight line by the separating roller 4*a* and the register roller 5*a* (ST03 in FIG. 15). Note that the timers T1 and T2 are both composed of delay circuits that count the reference clock of the control CPU 14 using a counter.

The control CPU 14 monitors the status of the stacker 1 size sensor 50 when it receives the paper feed instruction signal S03 from the main unit to recognize the length of the sheets stacked on the stacker 1. The sheet length recognition device 49 is configured to recognize a length of the sheet corresponding to the sheet position on the stacker 1 or the standard size based on a memory table on the ROM 52 with the signal of the size sensor 50.

The timer T2 sets the approximate time for the second transport device 5 to send the sheet for a length (L6 in FIG. 12) to form a loop for register correction of the leading edge of the sheet, and starts the double feed detection when the timer T2 expires. Electrical power is supplied to the wave sending element 6*a* at this time and ultrasonic waves are generated in a stable manner. Ultrasonic waves are received by the opposing wave receiving element 6*b* after passing through the sheet. The output corresponding to the status of the sheet is compared at the comparator circuit 13*c* with a preset reference value through the amp circuit 13*a* and the smoothing circuit 13*b* (ST05 in FIG. 15).

The results of the comparison are accumulated in a memory 53 and are then transferred to the judgment circuit of the control CPU 14. When the timer T2 expires and the double feed detection start signal S04 is received, the control CPU 14 clears the double feed comparison data of the memory 53. Accordingly, the data compared by the comparator circuit 13*c* is sequentially sent to the memory 53 along with the sheet moved by the second transport device 5. The control CPU 14 retrieves the comparison data to monitor the double feed of the sheets.

When the drive motor M starts again, the control CPU 14 detects the amount of the sheet feed of the second transport device 5 that is equivalent to the measurement length L0. As shown in FIG. 12, the counter 23 measures the encoder 21 connected to the register roller 5*b* to measure the amount of the sheet feed in the following way.

First, the counter 23 starts counting simultaneously with the rotation of the register roller 5*b*. When the sheet is transported by the measurement length L0, the control CPU 14 judges that the detection is completed and stops reading the comparison data from the memory 53. Next, after the trailing edge of the sheet is detected by the sheet edge detection device 7, the counter 23 stops counting when the timer T3 expires at the estimated time for the trailing edge of the sheet to reach the register roller 5*b* (ST06 in FIG. 15). Accordingly, the CPU detects the length of the transported sheet in the transport direction.

The control CPU 14 judges the double feed of the sheets in the following way. While the sheet is transported between the first and second transport devices 4 and 5, (A) the double feed detection device 6 generates the comparison data over the predetermined measurement length L0, and (B) the sheet length detected by the sheet size recognition device 49 is compared with the length of the transported sheet. In (A), the output data from the receiving circuit 13 is compared by the comparator circuit 13*c*, and it is judged whether there is a single sheet or the double feed with the comparison data. In (B), the transport direction length of the sheets set on the stacker 1 from the sheet size recognition device 49 is compared with the length of the transported sheet from the counter 23, and it is judged whether the sheets are shifted in the transport direction (ST07 in FIG. 15). Therefore, the judgment device 24 formed of the control CPU 14 judges erroneous transport sheets when the double feed of the sheets is detected in at least one of (A) and (B).

In the embodiment, the sheet size recognition device 49 detects the length of the sheets in the transport direction stacked on a stacker 1, and the sheet length may be detected as follows.

The maximum size of a transportable sheet is set as a specification for the apparatus, and a length of the maximum size sheet in the transport direction is stored in the ROM 52 as a setting value. The control CPU 14 is configured to detect the transport length of the sheet with the encoder 21 and the counter 23. The transport length is compared with the setting value from the ROM 52. If the transport length is larger than the setting value, the double feed is judged. The setting values may be classified for large, medium, and small sheets, and may be stored in the ROM 52. The sheet sensor 50 detects the length of the sheet on the stacker 1 in the transport direction. Then, the first setting value is selected for a large-sized sheet, the second setting value is selected for a medium-sized sheet, or the third setting value is selected for a small-sized sheet.

A method of detecting the double feed detection will be described next.

Step 1

The length of the sheet in the transport direction is recognized. The length of the sheets on the stacker 1 is detected. In the apparatus shown in FIG. 12, the sheet edge is detected by the size sensor 50 disposed on the stacker 1, and the standard size stored in the ROM 52 is selected, so that the length of the sheet in the transport direction is recognized.

Step 2

The overlapping of the sheets in the transport process is detected to judging the double feed. As shown in FIG. 12, the sheets are transported by the first and the second transport devices 4 and 5, and are detected by the double feed detection device 6 such as an ultrasonic wave sensor to judge the double feed by comparing the output data with the reference value.

Step 3

The transport length of the sheet in the transport path from the leading edge to the trailing edge is measured. As shown in FIG. 12, at least one of the transport amounts of the first and the second transport devices 4 and 5 that transporting sheets are measured by means such as an encoder 21 and a counter 23.

Step 4

The transport length of the sheet recognized in step 1 is compared with the transport length of the sheet measured in step 3. An operational device such as a CPU compares the values of the lengths.

Step 5

The transport error is judged based on the comparison result in step 4 and the comparison result in step 2. The transport error is judged when the sheet double feed is detected in step 2 or the transport length is detected to be larger than the sheet length in step 4. In the apparatus shown in FIG. 12, the control CPU 14 performs the judgment.

Figure 8:
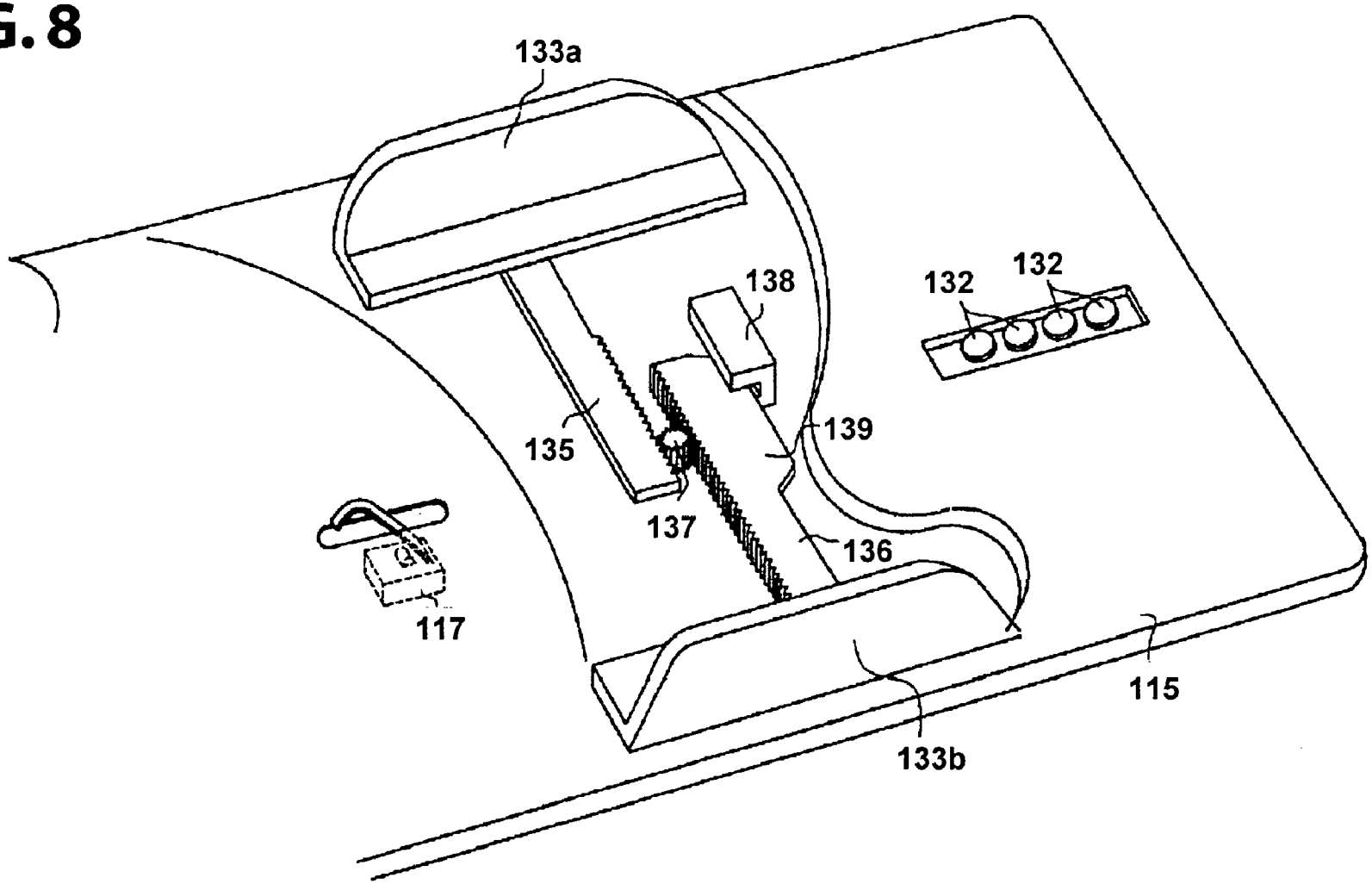
FIG. 8 is a view showing a paper feed stacker of the sheet supply unit shown in FIG. 7.

As shown in FIGS. 7 to 9, the size sensor 132 and the position sensor 138 on the side guide 133 detects the side of the sheet stacked on the paper feed stacker 115 in the transport direction and the width direction, and the length of the sheet is recognized. Similar to FIG. 12, an encoder and counter are arranged on the register roller 125*b* to detect the amount of rotation of the roller. The sheet is transported by the separating roller 119 and the register roller 125, and the length of the sheet in the transport direction from the leading edge to the trailing edge is detected. Similar to FIG. 12, the transport length and the sheet length are compared, and the output signal from the double feed detection device 123 is compared with the reference value to judge the double feed.

The disclosures of Japanese Patent Applications No. 2003-405438 and No. 2003-405440, both filed on Dec. 4, 2003, are incorporated in the application.

While the invention has been explained with reference to the specific embodiments of the invention, the explanation is illustrative and the invention is limited only by the appended claims.

What is claimed is:

1. A sheet feeding apparatus comprising:

a stacker for stacking a sheet, a sheet guide for guiding the sheet from the stacker to a predetermined processing position, first and second transport devices arranged in the sheet guide for transporting the sheet, a sheet length recognition device for recognizing at least two kinds of length of a sheet placed on the stacker in a transport direction, an ultrasonic double feed detection device arranged between the first transport device and the second transport device for detecting a double feed of sheets over a measurement region of the sheet, said double feed detection device comprising an oscillating element and a receiving element facing each other to allow the sheet to pass therebetween, and a judgment device for judging the double feed, said judgment device setting non-measurement regions at a leading edge and a trailing edge of the sheet in the transport direction based upon the length of the sheet recognized by the sheet length recognition device and judging the double feed based on detection data of one measurement region shorter than the length of the sheet and excluding the non-measurement regions.

2. A sheet feeding apparatus according to claim 1, wherein said first transport device includes a separating roller for separating the sheet stacked on the stacker, and said second transport device includes a register roller for temporarily holding the sheet from the separating roller.

3. A sheet feeding apparatus according to claim 2, wherein said separating roller and said register roller are connected to a drive device so that the separating roller and the register roller rotate in opposite directions, said judgment device judging the double feed based on data from the double feed detection device while the register roller is being rotated.

4. A sheet feeding apparatus according to claim 1, wherein said sheet length recognition device includes a sensor for detecting an edge of the sheet stacked on the stacker.

5. A sheet feeding apparatus according to claim 1, wherein said sheet length recognition device includes a sensor for detecting an edge of the sheet stacked on the stacker and a device for judging the length of the sheet in the transport direction based on a detection signal of the sensor, said judgment device setting the measurement region based upon the length of the sheet in the transport direction.

6. A sheet feeding apparatus according to claim 1, wherein said sheet length recognition device includes a device for detecting the length of the sheet in the transport direction, said judgment device setting the measurement region by subtracting a predetermined length from the length of the sheet.

7. An image reading apparatus comprising the sheet feeding apparatus according to claim 1, and a control device for canceling reading of an image on the sheet based on a signal from the judgment device.

8. A method of detecting a double feed of sheets, comprising:

a first step of identifying at least two kinds of length of a sheet in a transport direction, a second step of detecting the double feed of sheets in a predetermined length thereof with an ultrasonic double feed detection sensor comprising an oscillating element and a receiving element facing each other to allow the sheet to pass therebetween while the sheet is being transported, a third step of setting a measurement region based on the length of the sheet recognized in the first step, said measurement region excluding non-measurement regions formed at a leading edge and a trailing edge of the sheet so that the measurement region has a length less than the length of the sheet, and a fourth step of judging an erroneous transport of the sheet based on detection data from the double feed detection sensor over the measurement region set in the third step.

* * * * *